US011069365B2

(12) United States Patent
Kar et al.

(10) Patent No.: US 11,069,365 B2
(45) Date of Patent: Jul. 20, 2021

(54) DETECTION AND REDUCTION OF WIND NOISE IN COMPUTING ENVIRONMENTS

(71) Applicant: Intel Corporation, Santa Clara, CA (US)

(72) Inventors: Swarnendu Kar, Portland, OR (US); Anthony Rhodes, Portland, OR (US)

(73) Assignee: INTEL CORPORATION, Santa Clara, CA (US)

( * ) Notice: Subject to any disclaimer, the term of this patent is extended or adjusted under 35 U.S.C. 154(b) by 0 days.

(21) Appl. No.: 15/941,150

(22) Filed: Mar. 30, 2018

(65) Prior Publication Data

US 2019/0043520 A1 Feb. 7, 2019

(51) Int. Cl.

| | |
|---|---|
| ***G10L 21/0232*** | (2013.01) |
| ***G10L 21/028*** | (2013.01) |
| ***G10L 25/18*** | (2013.01) |
| ***H04R 1/40*** | (2006.01) |
| ***H04R 3/00*** | (2006.01) |
| ***G10L 21/0272*** | (2013.01) |

(52) U.S. Cl.

CPC ..... *G10L 21/0232* (2013.01); *G10L 21/0272* (2013.01); *H04R 1/406* (2013.01); *H04R 3/005* (2013.01); *H04R 2410/07* (2013.01); *H04R 2499/11* (2013.01)

(58) Field of Classification Search

CPC .... H04R 3/005; H04R 2499/11; H04R 1/406; H04R 1/1083; H04R 2410/05; H04R 2430/20; H04R 3/04; H04R 2201/401; H04R 2201/403; H04R 2460/01; H04R 2201/107; H04R 29/005; H04R 3/02; G10L 21/0208; G10L 21/0232; G10L 2021/02166; G10L 2021/02082; G10L 21/0264; G10L 15/20; G10L 2021/02165; G10L 25/51; G10L 21/02; G10L 21/0216; G10L 21/0224; G10L 21/0316; G10L 21/038; G10K 11/16; G10K 2210/3028; G10K 11/17854; G10K 2210/108; G10K 2210/3056; G10K 11/002; G10K 11/17823; G10K 2210/3045; G10K 2210/509; G10K 11/1781; H04M 9/082; H04M 1/6041; H04M 2250/12; H04M 3/002

USPC ..... 381/92, 94.1, 91, 94.7, 122, 71.1, 71.11, 381/317, 57; 379/406.01, 406.08

See application file for complete search history.

(56) References Cited

U.S. PATENT DOCUMENTS 9,159,336 B1 * 10/2015 Yang ..... G10L 21/0208
2004/0167777 A1 * 8/2004 Hetherington ..... G10L 21/0208 704/226

(Continued)

*Primary Examiner* — Ahmad F. Matar
*Assistant Examiner* — Kharye Pope
(74) *Attorney, Agent, or Firm* — Jaffery Watson Mendonsa & Hamilton LLP

(57) ABSTRACT

A mechanism is described for facilitating wind detection and wind noise reduction in computing environments according to one embodiment. An apparatus of embodiments, as described herein, includes wind detection logic to detect wind associated with the apparatus including a wearable computing device, wherein the wind is detected based on samples from multiple microphones and extraction and use of multiple features including spectral sub-band centroid (SSC) features and coherence features; and decision and execution logic to reduce wind noise associated with the detected wind.

17 Claims, 10 Drawing Sheets

(56) References Cited

U.S. PATENT DOCUMENTS

| | | | | |
|---|---|---|---|---|
| 2009/0254352 | A1* | 10/2009 | Zhao | G10L 25/78 704/500 |
| 2010/0030562 | A1* | 2/2010 | Yoshizawa | G10L 21/0208 704/270 |
| 2010/0067710 | A1* | 3/2010 | Hendriks | G10L 21/0208 381/58 |
| 2010/0082339 | A1* | 4/2010 | Konchitsky | G10L 21/0208 704/226 |
| 2011/0004470 | A1* | 1/2011 | Konchitsky | G10L 21/0208 704/226 |
| 2011/0305345 | A1* | 12/2011 | Bouchard | G10L 21/0208 381/23.1 |
| 2012/0022864 | A1* | 1/2012 | Leman | G10L 25/00 704/233 |
| 2012/0123771 | A1* | 5/2012 | Chen | G10L 21/0208 704/226 |
| 2012/0148067 | A1* | 6/2012 | Petersen | H04R 3/005 381/92 |
| 2012/0310639 | A1* | 12/2012 | Konchitsky | G10L 21/0208 704/226 |
| 2013/0308784 | A1* | 11/2013 | Dickins | H04R 3/005 381/56 |
| 2016/0012828 | A1* | 1/2016 | Chatlani | G10L 21/0232 704/205 |
| 2016/0232915 | A1* | 8/2016 | Lepauloux | G10L 21/0208 |
| 2016/0261951 | A1* | 9/2016 | Matheja | H03G 3/301 |
| 2016/0300562 | A1* | 10/2016 | Goldstein | G10K 11/17815 |
| 2017/0353809 | A1* | 12/2017 | Zhang | H04R 3/005 |
| 2018/0277138 | A1* | 9/2018 | Kudryavtsev | G10L 21/0232 |
| 2019/0259381 | A1* | 8/2019 | Ebenezer | G10L 25/21 |

* cited by examiner

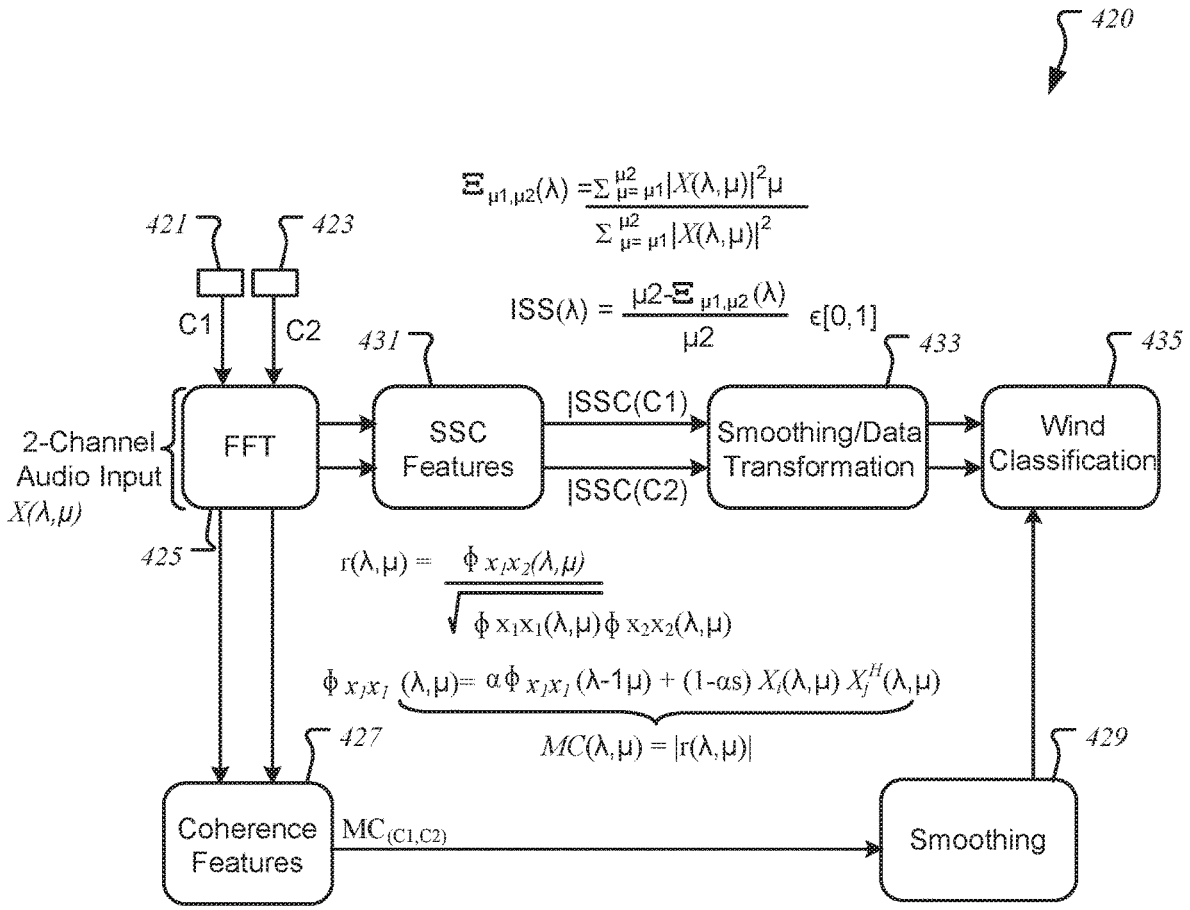

$$\Xi_{\mu1,\mu2}(\lambda) = \frac{\sum_{\mu=\mu1}^{\mu2} |X(\lambda,\mu)|^2 \mu}{\sum_{\mu=\mu1}^{\mu2} |X(\lambda,\mu)|^2}$$

$$ISS(\lambda) = \frac{\mu2 - \Xi_{\mu1,\mu2}(\lambda)}{\mu2} \in [0,1]$$

$$r(\lambda,\mu) = \frac{\phi_{x_1x_2}(\lambda,\mu)}{\sqrt{\phi_{x_1x_1}(\lambda,\mu)\,\phi_{x_2x_2}(\lambda,\mu)}}$$

$$\phi_{x_ix_j}(\lambda,\mu) = \underbrace{\alpha\,\phi_{x_ix_j}(\lambda-1\mu) + (1-\alpha s)\,X_i(\lambda,\mu)\,X_j^H(\lambda,\mu)}_{MC(\lambda,\mu) = |r(\lambda,\mu)|}$$

*FIG. 4B*

DETECTION AND REDUCTION OF WIND NOISE IN COMPUTING ENVIRONMENTS

FIELD

Embodiments described herein relate generally to data processing and more particularly to facilitate detection and reduction of wind noise in computing environments.

BACKGROUND

Wind noise is a predominant source of interference in voice-driven applications that use automatic speech recognition (ASR). Several conventional techniques offer passive wind noise detection; however, such techniques alone render a large quantity of false-positive results for low wind speed regime, which can be a critical range of ASR applications.

BRIEF DESCRIPTION OF THE DRAWINGS

Embodiments are illustrated by way of example, and not by way of limitation, in the figures of the accompanying drawings in which like reference numerals refer to similar elements.

FIG. 4B illustrates an architectural setup facilitating a transaction sequence for detection and reduction of wind noise in wearable devices according to one embodiment.

DETAILED DESCRIPTION

Figure 1:
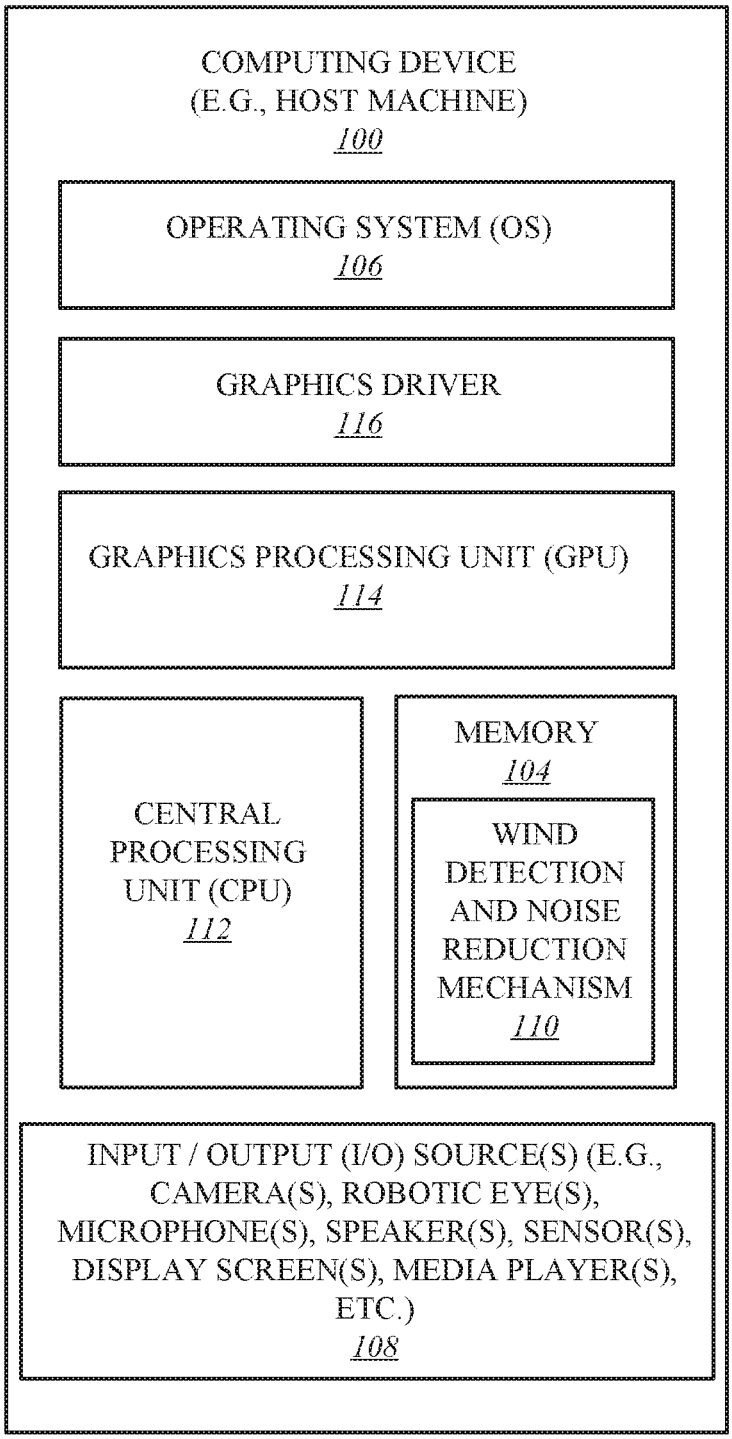
FIG. 1 illustrates a computing device employing a wind detection and noise reduction mechanism according to one embodiment.

In the following description, numerous specific details are set forth. However, embodiments, as described herein, may be practiced without these specific details. In other instances, well-known circuits, structures and techniques have not been shown in detail in order not to obscure the understanding of this description.

Embodiments provide for a novel technique for smart detection and reduction of wind noise in computing devices (e.g., wearable devices, such as head-mounted displays (HMDs)) using multiple microphones. Further, in one embodiment, this novel technique utilizes improved feature sets (e.g., signal sub-band centroids (SSC) features, coherence-based features, etc.) in addition to information from multiple microphones to discriminate the presence of wind with high accuracy, as will be further described throughout this document.

It is contemplated that terms like "request", "query", "job", "work", "work item", and "workload" may be referenced interchangeably throughout this document. Similarly, an "application" or "agent" may refer to or include a computer program, a software application, a game, a workstation application, etc., offered through an application programming interface (API), such as a free rendering API, such as Open Graphics Library (OpenGL®), DirectX® 11, DirectX® 12, etc., where "dispatch" may be interchangeably referred to as "work unit" or "draw" and similarly, "application" may be interchangeably referred to as "workflow" or simply "agent". For example, a workload, such as that of a three-dimensional (3D) game, may include and issue any number and type of "frames" where each frame may represent an image (e.g., sailboat, human face). Further, each frame may include and offer any number and type of work units, where each work unit may represent a part (e.g., mast of sailboat, forehead of human face) of the image (e.g., sailboat, human face) represented by its corresponding frame. However, for the sake of consistency, each item may be referenced by a single term (e.g., "dispatch", "agent", etc.) throughout this document.

In some embodiments, terms like "display screen" and "display surface" may be used interchangeably referring to the visible portion of a display device while the rest of the display device may be embedded into a computing device, such as a smartphone, a wearable device, etc. It is contemplated and to be noted that embodiments are not limited to any particular computing device, software application, hardware component, display device, display screen or surface, protocol, standard, etc. For example, embodiments may be applied to and used with any number and type of real-time applications on any number and type of computers, such as desktops, laptops, tablet computers, smartphones, head-mounted displays and other wearable devices, and/or the like. Further, for example, rendering scenarios for efficient performance using this novel technique may range from simple scenarios, such as desktop compositing, to complex scenarios, such as 3D games, augmented reality applications, etc.

It is to be noted that terms or acronyms like convolutional neural network (CNN), CNN, neural network (NN), NN, deep neural network (DNN), DNN, recurrent neural network (RNN), RNN, and/or the like, may be interchangeably referenced throughout this document. Further, terms like "autonomous machine" or simply "machine", "autonomous vehicle" or simply "vehicle", "autonomous agent" or simply "agent", "autonomous device" or "computing device", "robot", and/or the like, may be interchangeably referenced throughout this document.

FIG. 1 illustrates a computing device 100 employing a wind detection and noise reduction mechanism ("wind mechanism") 110 according to one embodiment. Computing device 100 represents a communication and data processing device including or representing any number and type of smart devices, such as (without limitation) smart command devices or intelligent personal assistants, home/office automation system, home appliances (e.g., washing machines, television sets, etc.), mobile devices (e.g., smartphones, tablet computers, etc.), gaming devices, handheld devices, wearable devices (e.g., smartwatches, smart bracelets, etc.), virtual reality (VR) devices, head-mounted display (HMDs), Internet of Things (IoT) devices, laptop computers, desktop computers, server computers, set-top boxes (e.g., Internet-based cable television set-top boxes, etc.), global positioning system (GPS)-based devices, etc.

In some embodiments, computing device 100 may include (without limitation) autonomous machines or artificially intelligent agents, such as a mechanical agents or machines, electronics agents or machines, virtual agents or machines, electro-mechanical agents or machines, etc. Examples of autonomous machines or artificially intelligent agents may include (without limitation) robots, autonomous vehicles (e.g., self-driving cars, self-flying planes, self-sailing boats, etc.), autonomous equipment (self-operating construction vehicles, self-operating medical equipment, etc.), and/or the like. Further, "autonomous vehicles" are not limed to automobiles but that they may include any number and type of autonomous machines, such as robots, autonomous equipment, household autonomous devices, and/or the like, and any one or more tasks or operations relating to such autonomous machines may be interchangeably referenced with autonomous driving.

Further, for example, computing device 100 may include a computer platform hosting an integrated circuit ("IC"), such as a system on a chip ("SoC" or "SOC"), integrating various hardware and/or software components of computing device 100 on a single chip.

As illustrated, in one embodiment, computing device 100 may include any number and type of hardware and/or software components, such as (without limitation) graphics processing unit ("GPU" or simply "graphics processor") 114, graphics driver (also referred to as "GPU driver", "graphics driver logic", "driver logic", user-mode driver (UMD), UMD, user-mode driver framework (UMDF), UMDF, or simply "driver") 116, central processing unit ("CPU" or simply "application processor") 112, memory 104, network devices, drivers, or the like, as well as input/output (I/O) sources 108, such as touchscreens, touch panels, touch pads, virtual or regular keyboards, virtual or regular mice, ports, connectors, etc. Computing device 100 may include operating system (OS) 106 serving as an interface between hardware and/or physical resources of computing device 100 and a user.

It is to be appreciated that a lesser or more equipped system than the example described above may be preferred for certain implementations. Therefore, the configuration of computing device 100 may vary from implementation to implementation depending upon numerous factors, such as price constraints, performance requirements, technological improvements, or other circumstances.

Embodiments may be implemented as any or a combination of: one or more microchips or integrated circuits interconnected using a parentboard, hardwired logic, software stored by a memory device and executed by a microprocessor, firmware, an application specific integrated circuit (ASIC), and/or a field programmable gate array (FPGA). The terms "logic", "module", "component", "engine", and "mechanism" may include, by way of example, software or hardware and/or a combination thereof, such as firmware.

In one embodiment, as illustrated, wind mechanism 110 may be hosted by memory 104 in communication with operating system 106 and further in communication with I/O source(s) 108 of computing device 100. In another embodiment, wind mechanism 110 may be hosted or facilitated by graphics driver 116. In yet another embodiment, wind mechanism 110 may be hosted by or part of graphics processing unit ("GPU" or simply graphics processor") 114 or firmware of graphics processor 114. For example, wind mechanism 110 may be embedded in or implemented as part of the processing hardware of graphics processor 114. Similarly, in yet another embodiment, wind mechanism 110 may be hosted by or part of central processing unit ("CPU" or simply "application processor") 112. For example, wind mechanism 110 may be embedded in or implemented as part of the processing hardware of application processor 112.

In yet another embodiment, wind mechanism 110 may be hosted by or part of any number and type of components of computing device 100, such as a portion of wind mechanism 110 may be hosted by memory 104 or part of operating system 116, another portion may be hosted by or part of graphics processor 114, another portion may be hosted by or part of application processor 112, while one or more portions of wind mechanism 110 may be hosted by or part of operating system 116 and/or any number and type of devices of computing device 100. It is contemplated that embodiments are not limited to any implementation or hosting of wind mechanism 110 and that one or more portions or components of wind mechanism 110 may be employed or implemented as hardware, software, or any combination thereof, such as firmware.

Computing device 100 may host network interface(s) to provide access to a network, such as a LAN, a wide area network (WAN), a metropolitan area network (MAN), a personal area network (PAN), Bluetooth, a cloud network, a mobile network (e.g., $3^{rd}$ Generation (3G), $4^{th}$ Generation (4G), etc.), an intranet, the Internet, etc. Network interface (s) may include, for example, a wireless network interface having antenna, which may represent one or more antenna (e). Network interface(s) may also include, for example, a wired network interface to communicate with remote devices via network cable, which may be, for example, an Ethernet cable, a coaxial cable, a fiber optic cable, a serial cable, or a parallel cable.

Embodiments may be provided, for example, as a computer program product which may include one or more machine-readable media having stored thereon machine-executable instructions that, when executed by one or more machines such as a computer, network of computers, or other electronic devices, may result in the one or more machines carrying out operations in accordance with embodiments described herein. A machine-readable medium may include, but is not limited to, floppy diskettes, optical disks, CD-ROMs (Compact Disc-Read Only Memories), and magneto-optical disks, ROMs, RAMs, EPROMs (Erasable Programmable Read Only Memories), EEPROMs (Electrically Erasable Programmable Read Only Memories), magnetic or optical cards, flash memory, or other type of media/machine-readable medium suitable for storing machine-executable instructions.

Moreover, embodiments may be downloaded as a computer program product, wherein the program may be transferred from a remote computer (e.g., a server) to a requesting computer (e.g., a client) by way of one or more data signals embodied in and/or modulated by a carrier wave or other propagation medium via a communication link (e.g., a modem and/or network connection).

Throughout the document, term "user" may be interchangeably referred to as "viewer", "observer", "speaker", "person", "individual", "end-user", and/or the like. It is to be noted that throughout this document, terms like "graphics domain" may be referenced interchangeably with "graphics processing unit", "graphics processor", or simply "GPU" and similarly, "CPU domain" or "host domain" may be referenced interchangeably with "computer processing unit", "application processor", or simply "CPU".

It is to be noted that terms like "node", "computing node", "server", "server device", "cloud computer", "computing device", "computing device computer", "machine", "host machine", "device", "computing device", "computer", "computing system", and the like, may be used interchangeably throughout this document. It is to be further noted that terms like "application", "software application", "program", "software program", "package", "software package", and the like, may be used interchangeably throughout this document. Also, terms like "job", "input", "request", "message", and the like, may be used interchangeably throughout this document.

Figure 2:
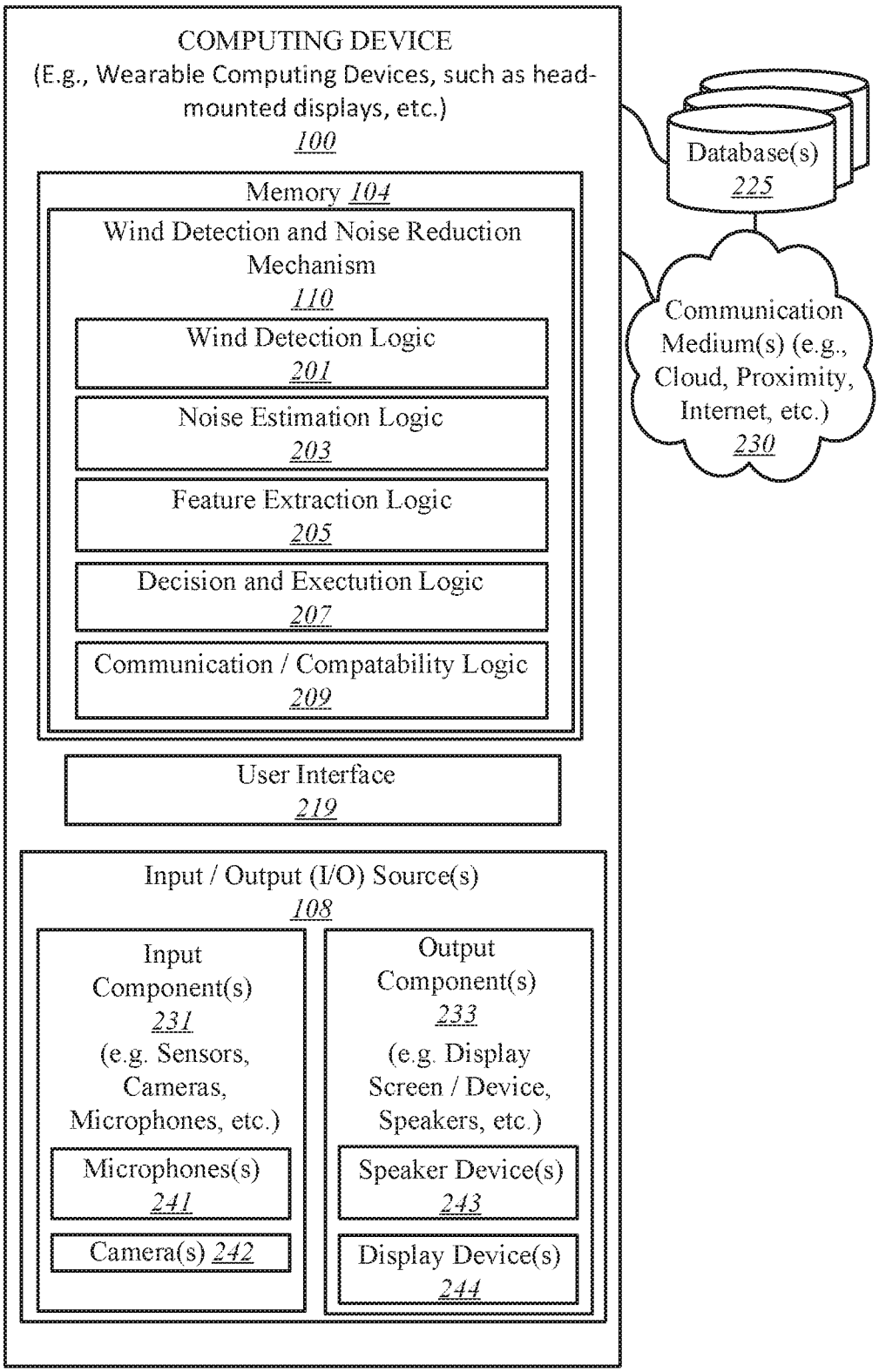
FIG. 2 illustrates the wind detection and noise reduction mechanism of FIG. 1 according to one embodiment.

FIG. 2 illustrates the wind detection and noise reduction mechanism 110 of FIG. 1 according to one embodiment. For brevity, many of the details already discussed with reference to FIG. 1 are not repeated or discussed hereafter. In one embodiment, wind mechanism 110 may include any number and type of components, such as (without limitations): wind detection logic 201; noise estimation logic 203; feature extraction logic 205; decision and execution logic 207; and communication/compatibility logic 209.

Computing device 100 (hereinafter also referenced as "wearable device", "head-wearable device" or simply "HMD") is further shown as including user interface 219 (e.g., GUI-based user interface, Web browser, cloud-based platform user interface, software application-based user interface, API, etc.). Wearable device 100 is further illustrated as having access to and/or being in communication with one or more database(s) 225 over one or more communication medium(s) 230 (e.g., networks such as a cloud network, a proximity network, the Internet, etc.). In some embodiments, database(s) 225 may include one or more of storage mediums or devices, repositories, data sources, etc., having any amount and type of information, such as data, metadata, etc., relating to any number and type of applications, such as data and/or metadata relating to users, estimations, computations, thresholds, decisions, physical locations or areas, applicable laws, policies and/or regulations, user preferences and/or profiles, security and/or authentication data, historical and/or preferred details, and/or the like.

As aforementioned, wearable device 100 may host I/O sources 108 including input component(s) 231 and output component(s) 233. In one embodiment, input component(s) 231 may include a sensor array including, but not limited to, microphone(s) 241 (e.g., ultrasound microphones), camera (s) 242 (e.g., two-dimensional (2D) cameras, three-dimensional (3D) cameras, infrared (IR) cameras, depth-sensing cameras, surveillance cameras, etc.), capacitors, radio components, radar components, scanners, and/or accelerometers, etc. Similarly, output component(s) 233 may include any number and type of speaker(s) 243, display device(s) or screen(s) 244 (e.g., screens, projectors, light-emitting diodes (LEDs)), and/or vibration motors, etc.

For example, as illustrated, input component(s) 231 may include any number and type of microphones(s) 241, such as multiple microphones or a microphone array, such as ultrasound microphones, dynamic microphones, fiber optic microphones, laser microphones, etc. It is contemplated that one or more of microphone(s) 241 serve as one or more input devices for accepting or receiving audio inputs (such as human voice) into computing device 100 and converting this audio or sound into electrical signals. Similarly, it is contemplated that one or more of camera(s) 242 serve as one or more input devices for detecting and capturing of image and/or videos of scenes, objects, etc., and provide the captured data as video inputs into computing device 100.

As described earlier, wind noise is a predominant source of interference in voice-driven applications that use ASR such that wind noise reduction (WNR) is regarded as a preprocessing step and can be achieved through passive techniques (e.g., foams, microphone design) and/or active techniques (e.g., software, algorithms). For example, to achieve WNR in software, detection of the presence of any wind is typically the first stage.

Embodiments provide for a novel technique for employing and using a multi-microphone wind detection (MMWD) technique as facilitated by wind mechanism 110. This novel technique may be developed on and used with any number and type of development environments and platforms, such as Intel® smart glass platform, where this novel technique provides for a significant performance improvement in various circumstances and environments.

Conventional techniques are single microphone-based, allowing for large quantity of false-positive results for low wind speed regimes that can be a critical range for ASR applications.

Embodiments provide for a novel wind mechanism 110 having wind detection logic 201 to detect and reduce wind noise in wearable devices, such as wearable device 100, using multiple microphones 241 and based on improved feature sets along with any information received through multiple microphones 241 to discriminate the presence of wind with highest possible accuracy.

For example, these feature sets include an SSC feature set having SSC features. It is contemplated spectral energy distribution of wind is characteristically dissimilar from speech; particularly, for extremely low frequencies. In one embodiment, this known fact is used by feature extraction logic 207 to compute or extract low-dimensional SSC for each microphone channel following a fast fourier transform (FFT) for use in wind detection by wind detection logic 201. This SSC feature is an extension to multiple microphones 241.

Another one of feature sets includes coherence-based feature set having coherence-based features that may be used along with any SSC features. For example, using feature extraction logic 207, in addition to SSC features, a 2-channel coherence associated with the captured audio is computed or extracted by feature extraction logic 207 using, for example, a recursive smoothed periodogram for power spectral density (PSD) estimates. More specifically, the magnitude of the coherence (MC) may be averaged for a current frame of captured audio, where values close to one indicate the presence of a strong power "transfer" between the two channels, while values close to zero show a weak power transfer. For example, wind alone may yield a small MC value, while speech alone produces a large MC value.

In one embodiment, using wind detection logic 201, a basic function of coherence features is used to improve the sensitivity of wind detection in low wind speed regimes by safeguarding against false-positive readings; particularly, in those cases when little to no wind is present. In such conditions, coherence features are used to provide a proxy for the extent to which a captured audio is "speech-like", such as by tuning the classification algorithm such that when both wind and speech are present simultaneously, wind detection "overwhelms" the presence of speech as detected by wind detection logic 201. In one embodiment, as facilitated by wind detection logic 201, the SSC and coherence features are gracefully threshold to achieve high accuracy for wind detection across a broad spectrum of wind intensities.

This novel technique allows for a much better wind detection accuracy (such as 90% and higher) in challenging, low wind intensity scenarios (such as 6 mph) and other conventional active approaches used in hearing aids. For example, the novel technique allows for virtually perfect accuracy in case of medium and strong wind. Further, for example, improved wind detection results in more accurate noise PSD estimation which, in turn, translates to a better speech recognition performance. The table below shows some results relating to representative speech recognizer:

TABLE 1

| Wind Speed | Word Error Rate - single mic WD | Word Error Rate - MMWD |
|---|---|---|
| 10 mph | 15.0% | 8.5% |
| 12 mph | 16.5% | 9.0% |
| 14 mph | 26.0% | 16.3% |
| 16 mph | 36.0% | 30.0% |

In one embodiment, wind detection logic 201 detects the wind and noise estimation logic 203 evaluates the detected wind to estimate any noise in or associated with the wind. For example, wind detection logic 201 is used to sufficiently and precisely detect the wind towards suppression of wind noise in captured signals as facilitated by decision and execution logic 207 and based on estimated features and evaluation of the wind and wind noise as facilitated feature extraction logic 205 and noise estimation logic 203, respectively.

In one embodiment, feature extraction logic 205 is used to seek and extract discriminative, low-dimensional features (such as used in low=computation regimes) for wind detection. Further, features for wind detection commonly rely on short-term statistics, such as the spectral energy distribution for very low frequencies (e.g., <10 Hz) for wind is discernible from that of speech. Upon performing numerous tests on potential features and estimation of wind noise in the wind as facilitated by noise estimation logic 203, certain features extracted by feature extraction logic 205 are then selected by decision and execution logic 207 for certain tasks, such as real-time, low-power wind detection, including short-term mean (STM), SSC, and coherence-based features, negative slope fit (NSF), and various neural-model approaches as decided and executed by decision and execution logic 207. For example, SSC features and coherence-based features may be selected by decision and execution logic 207 to achieve the best balance between low-computation and expressivity for wind detection.

For example, SSC features are extracted by feature extraction logic 205 and selected by decision and execution logic 207 for wind classification, etc., where samples are captured from wearer voice and segmented into several frames and frequency analysis as performed via FFT. For example, a spectral centroid is defined for time frame, k, with respect to the bin range [μ1, μ2]:

$$\Xi_{\mu1,\mu2}(\lambda) = \frac{\sum_{\mu=\mu1}^{\mu2} |X(\lambda, \mu)|^2 \cdot \mu}{\sum_{\mu=\mu1}^{\mu2} |X(\lambda, \mu)|^2}$$

Where X represents a short-time spectrum of the signal, where the sub-band range is considered as [0, 10], while an SSC-based wind indicator function for each signal channel is defined as:

$$I_{SSC}(\lambda) = \frac{\mu2 - \Xi_{\mu1,\mu2}(\lambda)}{\mu2} \in [0, 1]$$

Figure 3A:
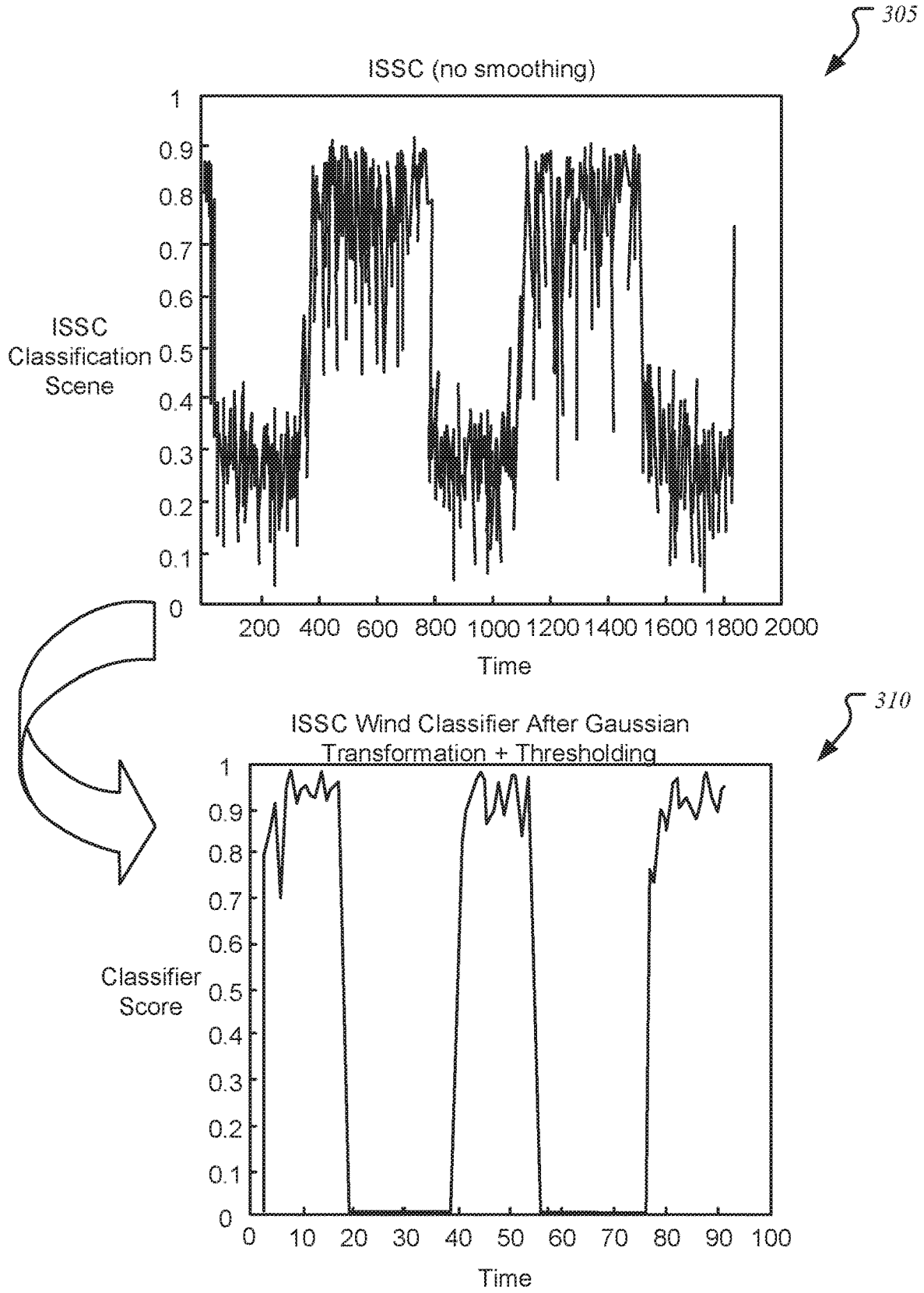
FIG. 3A illustrates graphs showing wind classifications according to one embodiment.

Due to a low-dimensional spectral representation used with SSC features, the wind indicator function could be rather noise and thus to generate a more robust model, a smoothing procedure (such as 500 ms windows) may be applied, which is then followed by a Gaussian fit to the $I_{SSC}$ function plus thresholding for wind classification. An example of this sequential workflow beginning with a single channel audio signal, SSC indicator function, smoothing and Gaussian thresholding for gusts of moderate intensity wind is shown in FIG. 3A. As illustrated, FIG. 3A illustrates graph 305 for $I_{SSC}$ (no smoothing) and graph 310 $I_{SSC}$ wind classifier after Gaussian Transformation and thresholding, respectively, to serve as examples of robust classification using SSC features, following smoothing and thresholding transformation according to one embodiment.

Figure 3B:
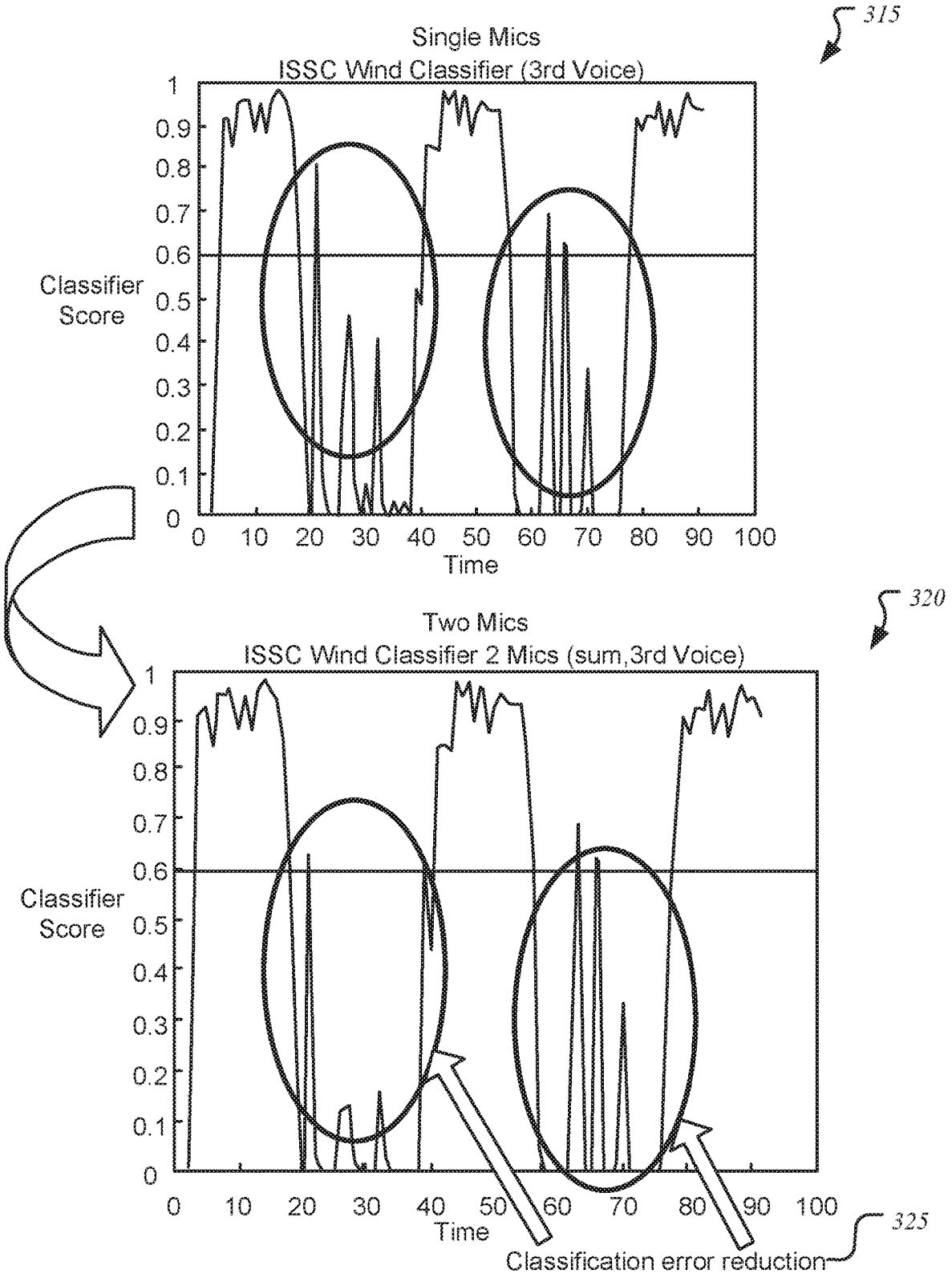
FIG. 3B illustrates graphs showing wind classifications according to one embodiment.

Further, to improve SSC-based wind classification for multi-channel audio, a maximum operation (max operation) is applied to promote robustness in case of the non-stationarity of wind noise, where evidence of this improved accuracy is this multi-channel matter is shown in FIG. 3B. FIG. 3B illustrates graph 315 for $I_{SSC}$ wind classifier (third voice) in case of a single microphone of microphones 241, while graph 320 shows $I_{SSC}$ wind classifier for two microphones of microphone(s) 241 for classification error reduction 325 and improved accuracy for multi-channel and SSC-based wind classification using max operation according to one embodiment.

Further, in adding to the effectiveness of using SSC-based features, this novel technique further provides for a high degree of sensitivity in low intensity wind (<=10 mph) scenarios and, in turn, improve classification in low intensity regimes (such as by mitigating false-positive readings). As mentioned above, SSC features are extracted by logic 205 and used by decision and execution logic 207.

Similarly, coherence-based features are extracted by extracted by logic 205 and used by decision and execution logic 207, where these multi-channel coherence features can be used to differentiate between target signals and undesirable noise, such as coherence quantifies the degree to which power "transfers" across signal channels. In this manner, coherence is used as a proxy for the extent to which the captured audio is "speech-like". For example, 2-channel coherence is defined as a ratio of cross-power spectral density (CPSD) and auto-power spectral densities (APSDs) as follows:

$$\Gamma(\lambda, \mu) = \frac{\phi_{x_1x_2}(\lambda, \mu)}{\sqrt{\phi_{x_1x_1}(\lambda, \mu)_{x_2x_2}(\lambda, \mu)}}$$

Where the PSDs are estimated by the recursive smoothed period-gram, such as:

$$\phi_{x_ix_j}(\lambda,\mu)=\alpha_s\phi_{x_ix_j}(\lambda-1,\mu)+(1-\alpha_s)X_i(\lambda,\mu)X_j^H(\lambda,\mu)$$

Where α is a smoothing constant set heuristically (α=0.8) and H represents a conjugate transpose operation. Further, from the 2-channel coherence, the magnitude of coherence (MC) is determined as a feature to discriminate between speech and noise:

$$MC(\lambda,\mu)=|\Gamma(\lambda,\mu)|$$

Figure 3C:
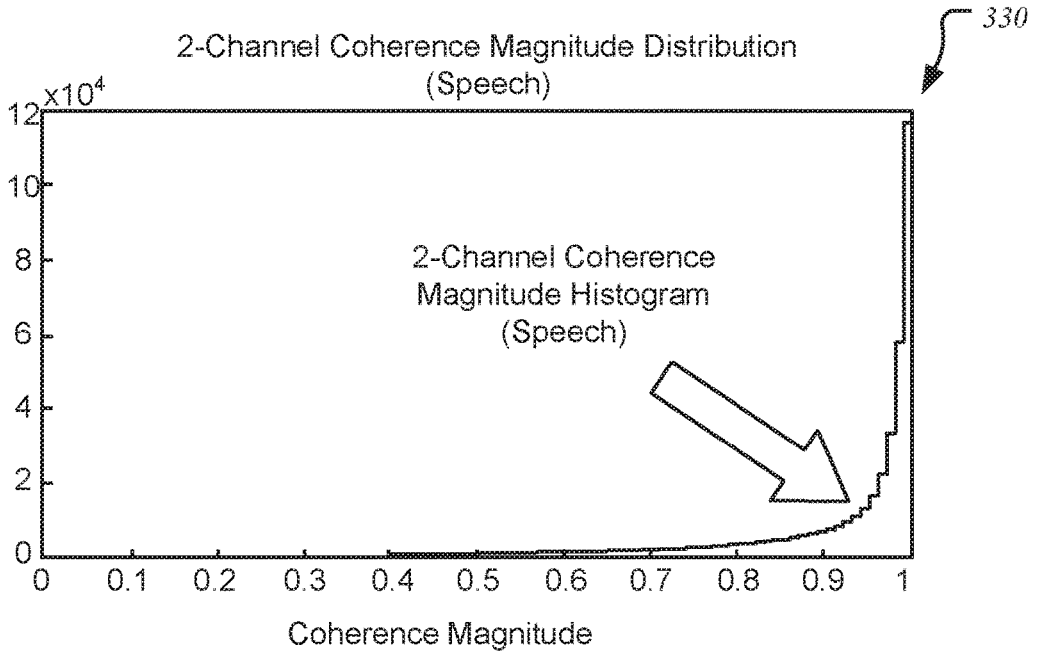
FIG. 3C illustrates graphs to demonstrate the differential statistical properties of magnitude of coherence for speech and wind according to one embodiment.
Figure 3C:
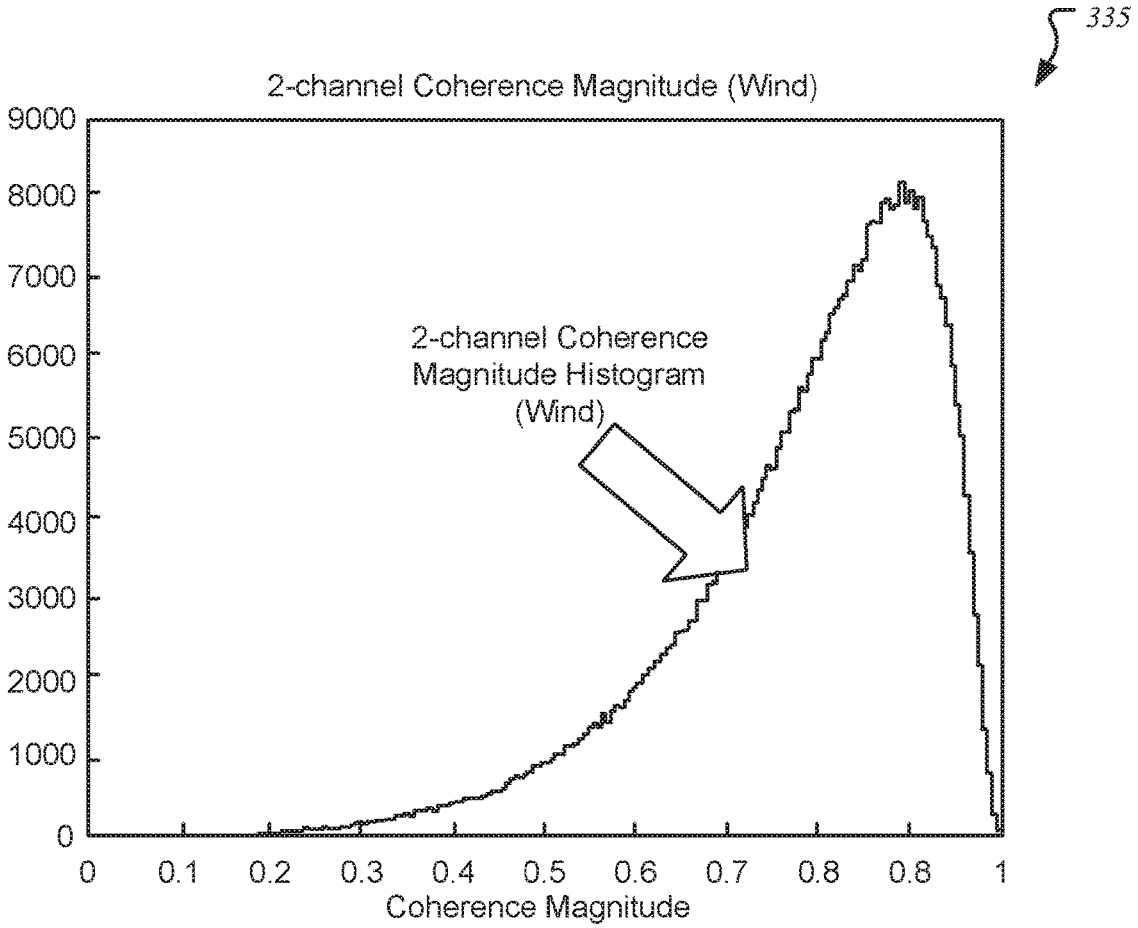

FIG. 3C illustrates graphs 330, 335 to demonstrate the differential statistical properties of MC for speech and wind by plotting the histogram of each, where 2-channel coherence magnitude histograms are compared for speech and wind according to one embodiment.

Now referring back to wind mechanism 110, wind detection logic 201 can work with or, in some embodiments, may include noise estimation through noise estimation logic 203, extraction of features using feature extraction logic 205, and deciding and executing wind noise reduction via decision and execution logic 207 as will be further illustrated and described with reference to FIG. 4A. For example, following FFT and estimation of noise associated with the detected wind as facilitated by noise estimation logic 203, SSC-based wind indicator functions or features may then be extracted or computed for each channel by feature extraction logic 205, followed by a windowed smoothing procedure (e.g., 500 ms) and further followed by performing a Gaussian transformation as facilitated by decision and execution logic 207. Subsequently, a max operation is applied across the 2-channel signal, while at the same time, the 2-channel coherence features and the average MC values are determined for the given time frame by decision and execution logic 207.

In one embodiment, decision and execution logic 207 applies smoothing for robustness, where wind classification is based on a conjunctive thresholding using the transformed SSC and coherence-based features together. The smoothing, Gaussian transform, and thresholding parameters are all determined heuristically to accord with the design and geometry of wearable device 100. Modifications to wearable designs of wearable device 100 and geometry can be accommodating by validating the parameter settings for smoothing, transforming, and thresholding stages under test conditions.

It is contemplated that embodiment are not limited to any number or type of use-case scenarios, architectural placements, or component setups; however, for the sake of brevity and clarity, illustrations and descriptions are offered and discussed throughout this document for exemplary purposes but that embodiments are not limited as such. Further, throughout this document, "user" may refer to someone having access to one or more computing devices, such as HMD 250, and may be referenced interchangeably with "person", "individual", "human", "him", "her", "child", "adult", "viewer", "player", "gamer", "developer", programmer", and/or the like.

Communication/compatibility logic 209 may be used to facilitate dynamic communication and compatibility between various components, networks, computing device 100, database(s) 225, and/or communication medium(s) 230, etc., and any number and type of other computing devices (such as wearable computing devices, mobile computing devices, desktop computers, server computing devices, etc.), processing devices (e.g., central processing unit (CPU), graphics processing unit (GPU), etc.), input components (e.g., non-visual data sensors/detectors, such as audio sensors, olfactory sensors, haptic sensors, signal sensors, vibration sensors, chemicals detectors, radio wave detectors, force sensors, weather/temperature sensors, body/biometric sensors, scanners, etc., and visual data sensors/detectors, such as cameras, etc.), user/context-awareness components and/or identification/verification sensors/devices (such as biometric sensors/detectors, scanners, etc.), memory or storage devices, data sources, and/or database(s) (such as data storage devices, hard drives, solid-state drives, hard disks, memory cards or devices, memory circuits, etc.), network(s) (e.g., Cloud network, Internet, Internet of Things, intranet, cellular network, proximity networks, such as Bluetooth, Bluetooth low energy (BLE), Bluetooth Smart, Wi-Fi proximity, Radio Frequency Identification, Near Field Communication, Body Area Network, etc.), wireless or wired communications and relevant protocols (e.g., Wi-Fi®, WiMAX, Ethernet, etc.), connectivity and location management techniques, software applications/websites, (e.g., social and/or business networking websites, business applications, games and other entertainment applications, etc.), programming languages, etc., while ensuring compatibility with changing technologies, parameters, protocols, standards, etc.

Throughout this document, terms like "logic", "component", "module", "framework", "engine", "tool", "circuitry", and/or the like, may be referenced interchangeably and include, by way of example, software, hardware, and/or any combination of software and hardware, such as firmware. In one example, "logic" may refer to or include a software component that to work with one or more of an operating system, a graphics driver, etc., of a computing device, such as computing device 100. In another example, "logic" may refer to or include a hardware component that is capable of being physically installed along with or as part of one or more system hardware elements, such as an application processor, a graphics processor, etc., of a computing device, such as computing device 100. In yet another embodiment, "logic" may refer to or include a firmware component that is capable of being part of system firmware, such as firmware of an application processor or a graphics processor, etc., of a computing device, such as computing device 100.

Further, any use of a particular brand, word, term, phrase, name, and/or acronym, such as "head-mounted display", "HMD", "wind", "wind noise", "wind noise estimating", "feature extracting", "SSC features", "coherence features", "spectral weighting", "segmenting and windowing", "frame index", "frequency bin", "real-time", "automatic", "dynamic", "user interface", "camera", "sensor", "microphone", "display screen", "speaker", "verification", "authentication", "privacy", "user", "user profile", "user preference", "sender", "receiver", "personal device", "smart device", "mobile computer", "wearable device", "IoT device", "proximity network", "cloud network", "server computer", etc., should not be read to limit embodiments to software or devices that carry that label in products or in literature external to this document.

It is contemplated that any number and type of components may be added to and/or removed from wind mechanism 110 to facilitate various embodiments including adding, removing, and/or enhancing certain features. For brevity, clarity, and ease of understanding of wind mechanism 110, many of the standard and/or known components, such as those of a computing device, are not shown or discussed here. It is contemplated that embodiments, as described herein, are not limited to any technology, topology, system, architecture, and/or standard and are dynamic enough to adopt and adapt to any future changes.

As described above with respect to FIG. 2, FIG. 3A illustrates graphs 305, 310 indicating robust classification using SSC features following soothing and thresholding transformation according to one embodiment. For brevity, many of the details previously discussed with reference to FIGS. 1-2 may not be discussed or repeated hereafter.

As described above with respect to FIG. 2, FIG. 3B illustrates graphs 315, 320 indicating robust classification using SSC features following soothing and thresholding transformation according to one embodiment. For brevity, many of the details previously discussed with reference to FIGS. 1-3A may not be discussed or repeated hereafter.

As described above with respect to FIG. 2, FIG. 3C illustrates graphs 330, 335 indicating robust classification using SSC features following soothing and thresholding transformation according to one embodiment. For brevity, many of the details previously discussed with reference to FIGS. 1-3B may not be discussed or repeated hereafter.

Figure 4A:
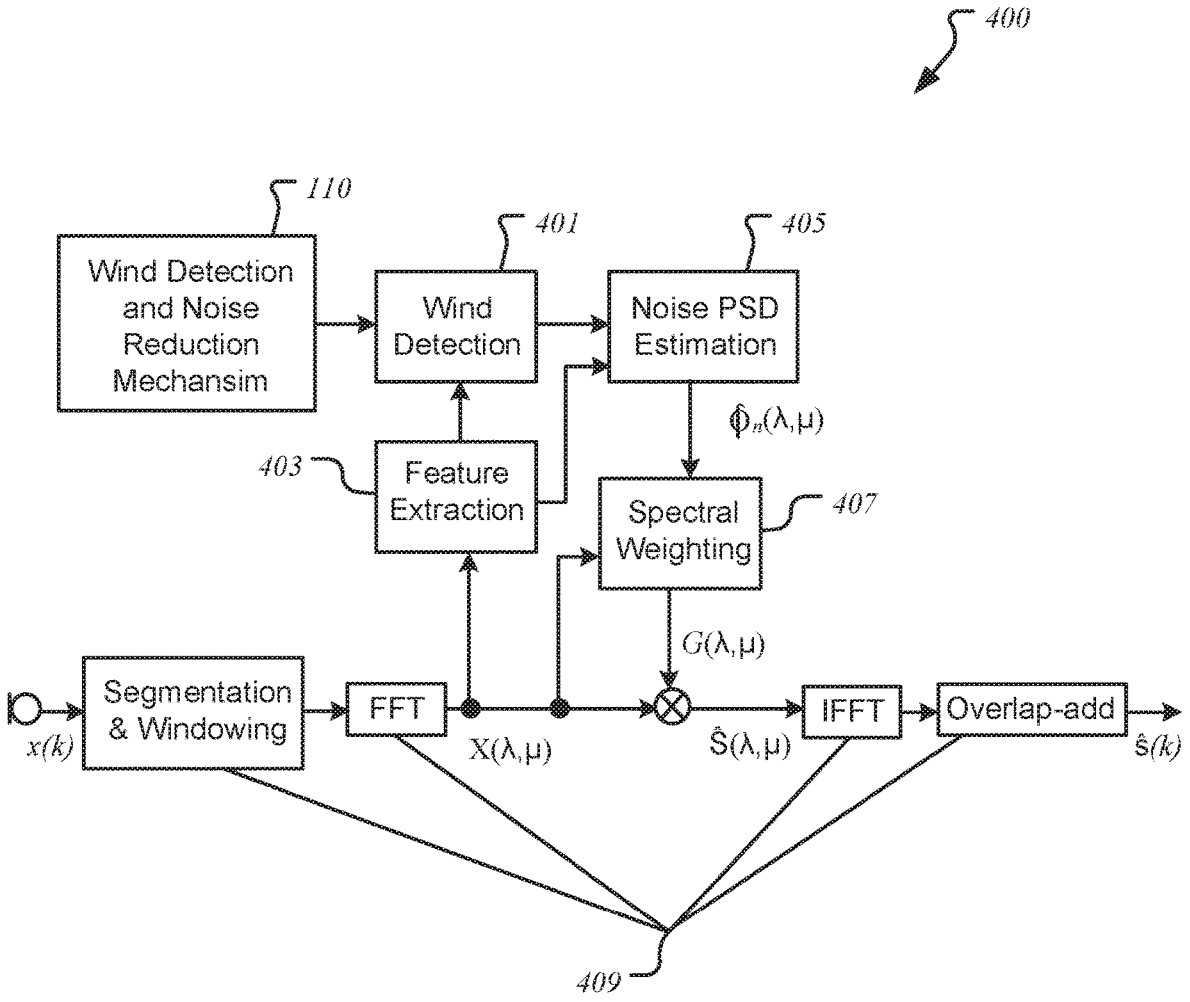
FIG. 4A illustrates an architectural setup facilitating a transaction sequence for detection and reduction of wind noise in wearable devices according to one embodiment.

FIG. 4A illustrates an architectural setup facilitating a transaction sequence 400 for detection and reduction of wind noise in wearable devices according to one embodiment. For brevity, many of the details previously discussed with reference to FIGS. 1-3C may not be discussed or repeated hereafter. Any processes or transactions may be performed by processing logic that may comprise hardware (e.g., circuitry, dedicated logic, programmable logic, etc.), software (such as instructions run on a processing device), or a combination thereof, as facilitated by wind mechanism 110 of FIG. 1. Any processes or transactions associated with this illustration may be illustrated or recited in linear sequences for brevity and clarity in presentation; however, it is contemplated that any number of them can be performed in parallel, asynchronously, or in different orders. Further, it contemplated that embodiments are not limited to this illustration of architectural setup or the flow of transaction sequence 400.

In one embodiment, wind detection at 401 is improved through noise mechanism 110 as described throughout this document; for example, FIG. 4B provides for various processes and components associated with wind detection at 401 as facilitated by wind mechanism 110. In one embodiment, transaction sequence 400 further provides for extraction of features at 403, such as SSC features, coherence features, etc., through process at 409 (including segmentation and windowing, FFT, overlapping-adding, etc.) to be used for wind detection at 401. Further, noise PSD is estimated at 405 and spectral weighting is performed at 409 to loop back with process at 409.

FIG. 4B illustrates an architectural setup facilitating a transaction sequence 420 for detection and reduction of wind noise in wearable devices according to one embodiment. For brevity, many of the details previously discussed with reference to FIGS. 1-4A may not be discussed or repeated hereafter. Any processes or transactions may be performed by processing logic that may comprise hardware (e.g., circuitry, dedicated logic, programmable logic, etc.), software (such as instructions run on a processing device), or a combination thereof, as facilitated by wind mechanism 110 of FIG. 1. Any processes or transactions associated with this illustration may be illustrated or recited in linear sequences for brevity and clarity in presentation; however, it is contemplated that any number of them can be performed in parallel, asynchronously, or in different orders. Further, it contemplated that embodiments are not limited to this illustration of architectural setup or the flow of transaction sequence 420.

Transactions sequence 420 begins receiving multiple audio inputs, such as a two-channel audio input based on samples 1 and samples 2 from channel 1 421 and channel 2 423, respectively, to perform a short-term fourier transform (STFT) and/or FFT, etc., at block 425, where these samples are extracted from wearer voice and segmented into several frames. Transaction sequence 420 continues with extraction and use of coherence features at block 427, where coherence features are used to differentiate between target signal and undesirable noise to achieve smoothness at block 427. Further, coherence features are further used to quantify the degree to which power transfers across signal channels, where coherence features can be used as proxies for the extent to which the captured audio is speech-like. Such coherence features are further used as a measure of similarity between signals and this is akin to correlation, except that coherence is calculated for all frequency bins, such as different frequency having potentially different similarity values. This smoothness of block 429, achieved through coherence features of block 427, is then used with obtaining wind classification at block 435.

In parallel to coherence features of block 427, in one embodiment, SSC features are extracted and used at block 431, where SSC features are used to obtain smoothing and/or data transformation at block 433, which is then used, along with smoothness of block 429, to obtain wind classification at block 435. These SSC features provide for a metric for measuring the shape of a frequency spectrum, such as energy of high-frequencies relative to energy of low-frequencies.

This novel transaction sequence 420 provides for a low-power detection for wearable devices, such as wearable device 100, multi-channel use of SSC features of block 431, multi-channel use of coherence features of block 427, and the use of a combination of SSC and coherence features to achieve wind classification 435 and subsequently, wind detection and wind noise reduction from wearable devices.

Figure 4C:
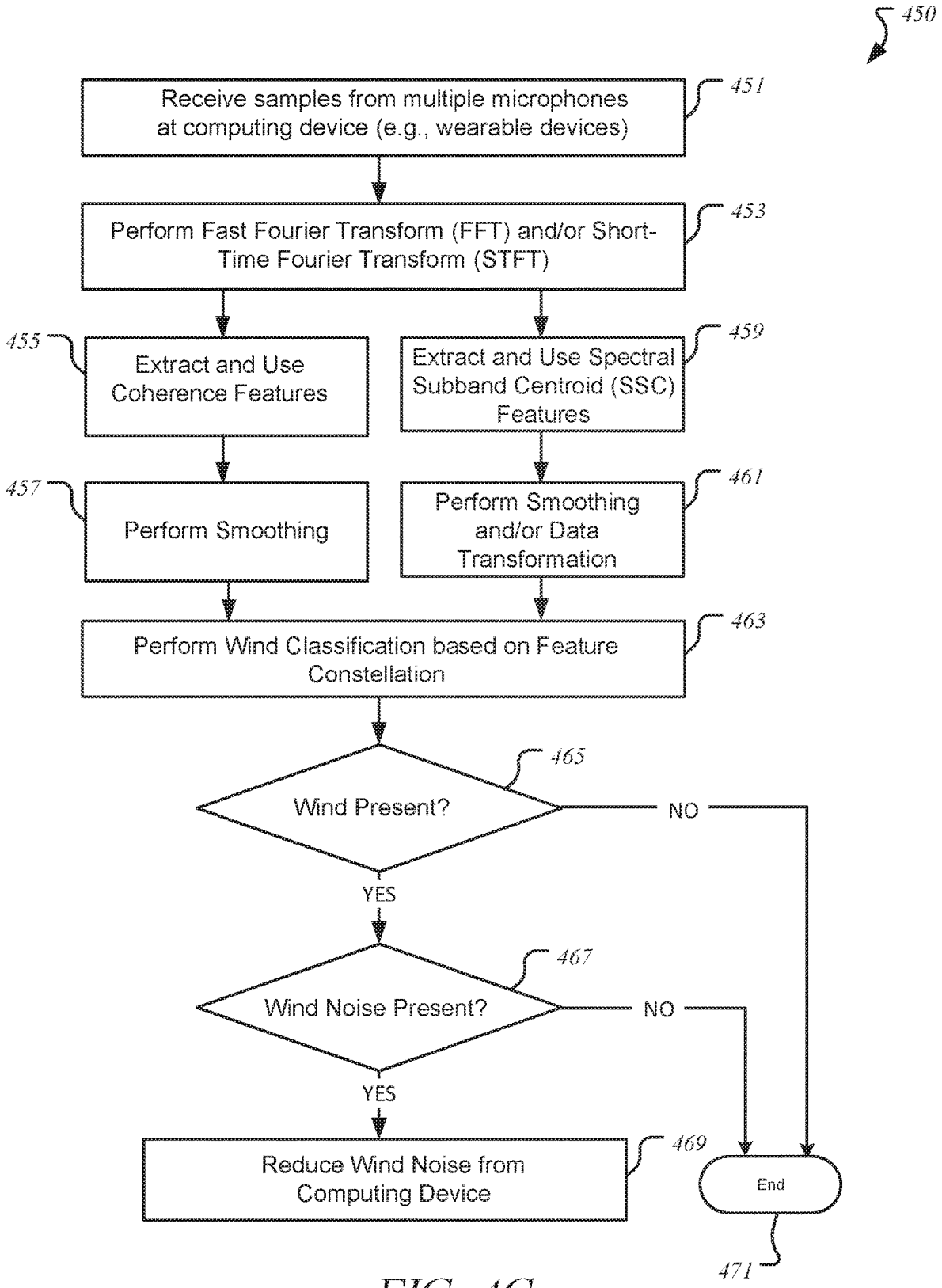
FIG. 4C illustrates an architectural setup facilitating a method for detection and reduction of wind noise in wearable devices according to one embodiment.

FIG. 4C illustrates an architectural setup facilitating a method 450 for detection and reduction of wind noise in wearable devices according to one embodiment. For brevity, many of the details previously discussed with reference to FIGS. 1-4A may not be discussed or repeated hereafter. Any processes or transactions may be performed by processing logic that may comprise hardware (e.g., circuitry, dedicated logic, programmable logic, etc.), software (such as instructions run on a processing device), or a combination thereof, as facilitated by wind mechanism 110 of FIG. 1. Any processes or transactions associated with this illustration may be illustrated or recited in linear sequences for brevity and clarity in presentation; however, it is contemplated that any number of them can be performed in parallel, asynchronously, or in different orders.

Method 450 begins at block 451 with receiving multiple samples of input from multiple channels at a computing device, such as a wearable device (e.g., HMD). At block 453, STFT and/or FFT processes are performed on the received multiple samples. STFT refers to analyzing a one-dimensional (1D) time-series signal into a two-dimensional (2D) time-frequency spectrogram by subsampling in time using sliding windows and performing FFT on each of the windows. Similarly, FFT refers to a process that samples a signal over a period of time or space and divides it into its frequency components, where such components are single sinusoidal oscillations at distinct frequencies with their own amplitude and phase.

At block 455, coherence features are extracted and used for potential wind detection and wind noise reduction, where coherence features refer to a measure of similarity between signals and this is akin to correlation, except that coherence is calculated for all frequency bins, such as different frequency components have potentially different similarity values. This use of coherence features then leads to smoothing at block 457, where smoothing refers to retaining at least some amount of past context, while only a fraction of new information is integrated, such as y_{t+1}=a*y_t+(1−a)*x_t→a=0=>no smoothing and a=1=>no new information this is applied both in \Phi_{x1,x2} and I(lambda).

In one embodiment, simultaneously with extraction and use of coherence features of block 455, at block 459, SSC features are extracted and used for potential wind detection and wind noise reduction, where SSC features refer to metrics for measuring the shape of a frequency spectrum (e.g., energy of high-frequencies relative to energies of low-frequencies). At block 461, smoothing and/or data transformation is performed, where again, smoothing refers to retaining at least some amount of past context, while merely a fraction new information is integrated.

At block 463, in one embodiment, wind classification is performed based on feature constellation, where wind classification refers to automatic taking of various measurements (such as features or based on features) as inputs and generating of class labels as output. Similarly, feature constellation refers to a graphical representation of multi-dimensional input features such that each class is labeled differently so that any decision boundaries are clearly visualized.

At block 465, a determination is made as to whether any wind is detected using the novel technique described above. If not, method 450 ends at block 471. If, however, any wind is detected, then method 450 continues at block 467 with another determination as to whether there is any wind noise associated with the wind. If not, method 450 end at block 471. If, however, wind noise is detected, then this wind noise is removed or at least reduced from the wearable device to enhance the user experience for the user wearing or having access to the wearable device.

Figure 5:
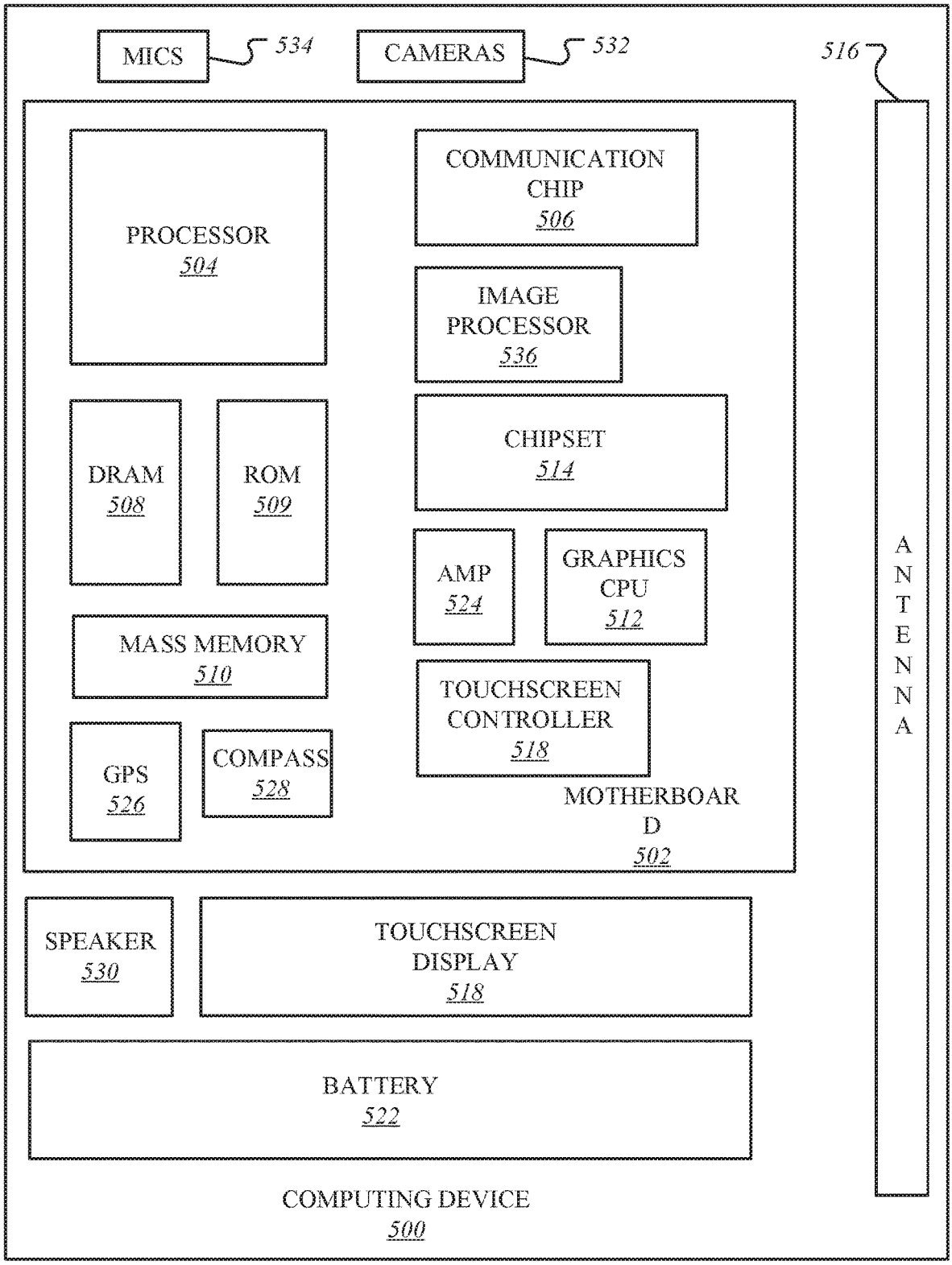
FIG. 5 illustrates a computer device capable of supporting and implementing one or more embodiments according to one embodiment.

FIG. 5 illustrates a computing device 500 in accordance with one implementation. The illustrated computing device 500 may be same as or similar to computing devices 100, 250 of FIG. 2. The computing device 500 houses a system board 502. The board 502 may include a number of components, including but not limited to a processor 504 and at least one communication package 506. The communication package is coupled to one or more antennas 516. The processor 504 is physically and electrically coupled to the board 502.

Depending on its applications, computing device 500 may include other components that may or may not be physically and electrically coupled to the board 502. These other components include, but are not limited to, volatile memory (e.g., DRAM) 508, non-volatile memory (e.g., ROM) 509, flash memory (not shown), a graphics processor 512, a digital signal processor (not shown), a crypto processor (not shown), a chipset 514, an antenna 516, a display 518 such as a touchscreen display, a touchscreen controller 520, a battery 522, an audio codec (not shown), a video codec (not shown), a power amplifier 524, a global positioning system (GPS) device 526, a compass 528, an accelerometer (not shown), a gyroscope (not shown), a speaker 530, cameras 532, a microphone array 534, and a mass storage device (such as hard disk drive) 510, compact disk (CD) (not shown), digital versatile disk (DVD) (not shown), and so forth). These components may be connected to the system board 502, mounted to the system board, or combined with any of the other components.

The communication package 506 enables wireless and/or wired communications for the transfer of data to and from the computing device 500. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication package 506 may implement any of a number of wireless or wired standards or protocols, including but not limited to Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPRS, CDMA, TDMA, DECT, Bluetooth, Ethernet derivatives thereof, as well as any other wireless and wired protocols that are designated as 3G, 4G, 5G, and beyond. The computing device 500 may include a plurality of communication packages 506. For instance, a first communication package 506 may be dedicated to shorter range wireless communications such as Wi-Fi and Bluetooth and a second communication package 506 may be dedicated to longer range wireless communications such as GPS, EDGE, GPRS, CDMA, WiMAX, LTE, Ev-DO, and others.

The cameras 532 including any depth sensors or proximity sensor are coupled to an optional image processor 536 to perform conversions, analysis, noise reduction, comparisons, depth or distance analysis, image understanding, and other processes as described herein. The processor 504 is coupled to the image processor to drive the process with interrupts, set parameters, and control operations of image processor and the cameras. Image processing may instead be performed in the processor 504, the graphics CPU 512, the cameras 532, or in any other device.

In various implementations, the computing device 500 may be a laptop, a netbook, a notebook, an ultrabook, a smartphone, a tablet, a personal digital assistant (PDA), an ultra mobile PC, a mobile phone, a desktop computer, a server, a set-top box, an entertainment control unit, a digital camera, a portable music player, or a digital video recorder. The computing device may be fixed, portable, or wearable. In further implementations, the computing device 500 may be any other electronic device that processes data or records data for processing elsewhere.

Embodiments may be implemented using one or more memory chips, controllers, CPUs (Central Processing Unit), microchips or integrated circuits interconnected using a motherboard, an application specific integrated circuit (ASIC), and/or a field programmable gate array (FPGA). The term "logic" may include, by way of example, software or hardware and/or combinations of software and hardware.

References to "one embodiment", "an embodiment", "example embodiment", "various embodiments", etc., indicate that the embodiment(s) so described may include particular features, structures, or characteristics, but not every embodiment necessarily includes the particular features, structures, or characteristics. Further, some embodiments may have some, all, or none of the features described for other embodiments.

In the following description and claims, the term "coupled" along with its derivatives, may be used. "Coupled" is used to indicate that two or more elements co-operate or interact with each other, but they may or may not have intervening physical or electrical components between them.

As used in the claims, unless otherwise specified, the use of the ordinal adjectives "first", "second", "third", etc., to describe a common element, merely indicate that different instances of like elements are being referred to, and are not intended to imply that the elements so described must be in a given sequence, either temporally, spatially, in ranking, or in any other manner.

The drawings and the forgoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein. Moreover, the actions of any flow diagram need not be implemented in the order shown; nor do all of the acts necessarily need to be performed. Also, those acts that are not dependent on other acts may be performed in parallel with the other acts. The scope of embodiments is by no means limited by these specific examples. Numerous variations, whether explicitly given in the specification or not, such as differences in structure, dimension, and use of material, are possible. The scope of embodiments is at least as broad as given by the following claims.

Embodiments may be provided, for example, as a computer program product which may include one or more transitory or non-transitory machine-readable storage media having stored thereon machine-executable instructions that, when executed by one or more machines such as a computer, network of computers, or other electronic devices, may result in the one or more machines carrying out operations in accordance with embodiments described herein. A machine-readable medium may include, but is not limited to, floppy diskettes, optical disks, CD-ROMs (Compact Disc-Read Only Memories), and magneto-optical disks, ROMs, RAMs, EPROMs (Erasable Programmable Read Only Memories), EEPROMs (Electrically Erasable Programmable Read Only Memories), magnetic or optical cards, flash memory, or other type of media/machine-readable medium suitable for storing machine-executable instructions.

Figure 6:
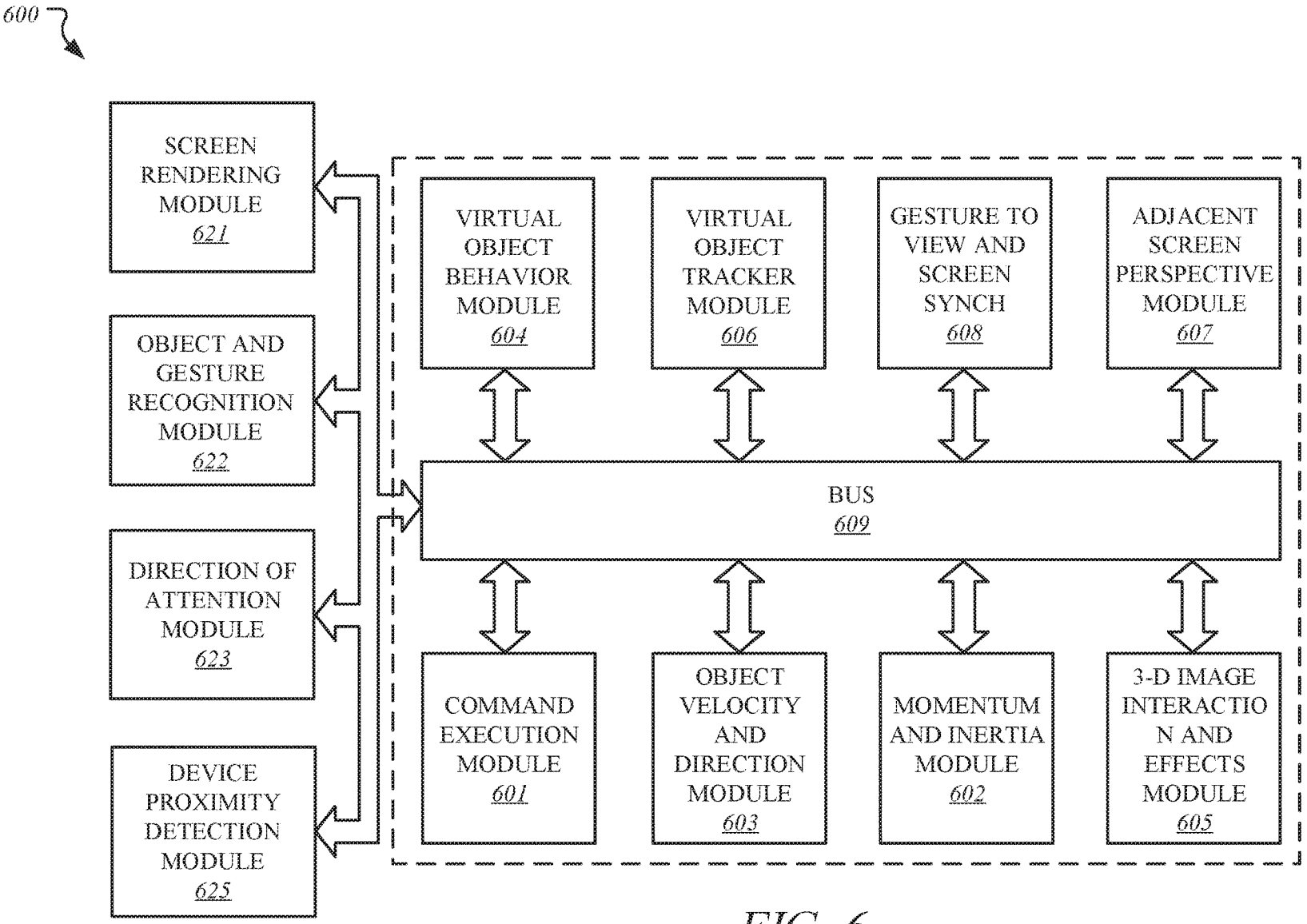
FIG. 6 illustrates an embodiment of a computing environment capable of supporting and implementing one or more embodiments according to one embodiment.

FIG. 6 illustrates an embodiment of a computing environment 600 capable of supporting the operations discussed above. The modules and systems can be implemented in a variety of different hardware architectures and form factors including that shown in FIG. 5.

The Command Execution Module 601 includes a central processing unit to cache and execute commands and to distribute tasks among the other modules and systems shown. It may include an instruction stack, a cache memory to store intermediate and final results, and mass memory to store applications and operating systems. The Command Execution Module may also serve as a central coordination and task allocation unit for the system.

The Screen Rendering Module 621 draws objects on the one or more multiple screens for the user to see. It can be adapted to receive the data from the Virtual Object Behavior Module 604, described below, and to render the virtual object and any other objects and forces on the appropriate screen or screens. Thus, the data from the Virtual Object Behavior Module would determine the position and dynamics of the virtual object and associated gestures, forces and objects, for example, and the Screen Rendering Module would depict the virtual object and associated objects and environment on a screen, accordingly. The Screen Rendering Module could further be adapted to receive data from the Adjacent Screen Perspective Module 607, described below, to either depict a target landing area for the virtual object if the virtual object could be moved to the display of the device with which the Adjacent Screen Perspective Module is associated. Thus, for example, if the virtual object is being moved from a main screen to an auxiliary screen, the Adjacent Screen Perspective Module 2 could send data to the Screen Rendering Module to suggest, for example in shadow form, one or more target landing areas for the virtual object on that track to a user's hand movements or eye movements.

The Object and Gesture Recognition Module 622 may be adapted to recognize and track hand and arm gestures of a user. Such a module may be used to recognize hands, fingers, finger gestures, hand movements and a location of hands relative to displays. For example, the Object and Gesture Recognition Module could for example determine that a user made a body part gesture to drop or throw a virtual object onto one or the other of the multiple screens, or that the user made a body part gesture to move the virtual object to a bezel of one or the other of the multiple screens. The Object and Gesture Recognition System may be coupled to a camera or camera array, a microphone or microphone array, a touch screen or touch surface, or a pointing device, or some combination of these items, to detect gestures and commands from the user.

The touch screen or touch surface of the Object and Gesture Recognition System may include a touch screen sensor. Data from the sensor may be fed to hardware, software, firmware or a combination of the same to map the touch gesture of a user's hand on the screen or surface to a corresponding dynamic behavior of a virtual object. The sensor date may be used to momentum and inertia factors to allow a variety of momentum behavior for a virtual object based on input from the user's hand, such as a swipe rate of a user's finger relative to the screen. Pinching gestures may be interpreted as a command to lift a virtual object from the display screen, or to begin generating a virtual binding associated with the virtual object or to zoom in or out on a display. Similar commands may be generated by the Object and Gesture Recognition System using one or more cameras without the benefit of a touch surface.

The Direction of Attention Module 623 may be equipped with cameras or other sensors to track the position or orientation of a user's face or hands. When a gesture or voice command is issued, the system can determine the appropriate screen for the gesture. In one example, a camera is mounted near each display to detect whether the user is facing that display. If so, then the direction of attention module information is provided to the Object and Gesture Recognition Module 622 to ensure that the gestures or commands are associated with the appropriate library for the active display. Similarly, if the user is looking away from all of the screens, then commands can be ignored.

The Device Proximity Detection Module 625 can use proximity sensors, compasses, GPS (global positioning system) receivers, personal area network radios, and other types of sensors, together with triangulation and other techniques to determine the proximity of other devices. Once a nearby device is detected, it can be registered to the system and its type can be determined as an input device or a display device or both. For an input device, received data may then be applied to the Object Gesture and Recognition Module 622. For a display device, it may be considered by the Adjacent Screen Perspective Module 607.

The Virtual Object Behavior Module 604 is adapted to receive input from the Object Velocity and Direction Module, and to apply such input to a virtual object being shown in the display. Thus, for example, the Object and Gesture Recognition System would interpret a user gesture and by mapping the captured movements of a user's hand to recognized movements, the Virtual Object Tracker Module would associate the virtual object's position and movements to the movements as recognized by Object and Gesture Recognition System, the Object and Velocity and Direction Module would capture the dynamics of the virtual object's movements, and the Virtual Object Behavior Module would receive the input from the Object and Velocity and Direction Module to generate data that would direct the movements of the virtual object to correspond to the input from the Object and Velocity and Direction Module.

The Virtual Object Tracker Module 606 on the other hand may be adapted to track where a virtual object should be located in three-dimensional space in a vicinity of a display, and which body part of the user is holding the virtual object, based on input from the Object and Gesture Recognition Module. The Virtual Object Tracker Module 606 may for example track a virtual object as it moves across and between screens and track which body part of the user is holding that virtual object. Tracking the body part that is holding the virtual object allows a continuous awareness of the body part's air movements, and thus an eventual awareness as to whether the virtual object has been released onto one or more screens.

The Gesture to View and Screen Synchronization Module 608, receives the selection of the view and screen or both from the Direction of Attention Module 623 and, in some cases, voice commands to determine which view is the active view and which screen is the active screen. It then causes the relevant gesture library to be loaded for the Object and Gesture Recognition Module 622. Various views of an application on one or more screens can be associated with alternative gesture libraries or a set of gesture templates for a given view. As an example, in FIG. 1A, a pinch-release gesture launches a torpedo, but in FIG. 1B, the same gesture launches a depth charge.

The Adjacent Screen Perspective Module 607, which may include or be coupled to the Device Proximity Detection Module 625, may be adapted to determine an angle and position of one display relative to another display. A projected display includes, for example, an image projected onto a wall or screen. The ability to detect a proximity of a nearby screen and a corresponding angle or orientation of a display projected therefrom may for example be accomplished with either an infrared emitter and receiver, or electromagnetic or photo-detection sensing capability. For technologies that allow projected displays with touch input, the incoming video can be analyzed to determine the position of a projected display and to correct for the distortion caused by displaying at an angle. An accelerometer, magnetometer, compass, or camera can be used to determine the angle at which a device is being held while infrared emitters and cameras could allow the orientation of the screen device to be determined in relation to the sensors on an adjacent device. The Adjacent Screen Perspective Module 607 may, in this way, determine coordinates of an adjacent screen relative to its own screen coordinates. Thus, the Adjacent Screen Perspective Module may determine which devices are in proximity to each other, and further potential targets for moving one or more virtual objects across screens. The Adjacent Screen Perspective Module may further allow the position of the screens to be correlated to a model of three-dimensional space representing all of the existing objects and virtual objects.

The Object and Velocity and Direction Module 603 may be adapted to estimate the dynamics of a virtual object being moved, such as its trajectory, velocity (whether linear or angular), momentum (whether linear or angular), etc. by receiving input from the Virtual Object Tracker Module. The Object and Velocity and Direction Module may further be adapted to estimate dynamics of any physics forces, by for example estimating the acceleration, deflection, degree of stretching of a virtual binding, etc. and the dynamic behavior of a virtual object once released by a user's body part. The Object and Velocity and Direction Module may also use image motion, size and angle changes to estimate the velocity of objects, such as the velocity of hands and fingers The Momentum and Inertia Module 602 can use image motion, image size, and angle changes of objects in the image plane or in a three-dimensional space to estimate the velocity and direction of objects in the space or on a display. The Momentum and Inertia Module is coupled to the Object and Gesture Recognition Module 622 to estimate the velocity of gestures performed by hands, fingers, and other body parts and then to apply those estimates to determine momentum and velocities to virtual objects that are to be affected by the gesture.

The 3D Image Interaction and Effects Module 605 tracks user interaction with 3D images that appear to extend out of one or more screens. The influence of objects in the z-axis (towards and away from the plane of the screen) can be calculated together with the relative influence of these objects upon each other. For example, an object thrown by a user gesture can be influenced by 3D objects in the foreground before the virtual object arrives at the plane of the screen. These objects may change the direction or velocity of the projectile or destroy it entirely. The object can be rendered by the 3D Image Interaction and Effects Module in the foreground on one or more of the displays. As illustrated, various components, such as components 601, 602, 603, 604, 605, 606, 607, and 608 are connected via an interconnect or a bus, such as bus 609.

The following clauses and/or examples pertain to further embodiments or examples. Specifics in the examples may be used anywhere in one or more embodiments. The various features of the different embodiments or examples may be variously combined with some features included and others excluded to suit a variety of different applications. Examples may include subject matter such as a method, means for performing acts of the method, at least one machine-readable medium including instructions that, when performed by a machine cause the machine to perform acts of the method, or of an apparatus or system for facilitating hybrid communication according to embodiments and examples described herein.

Some embodiments pertain to Example 1 that includes an apparatus to facilitate wind detection and wind noise reduction in computing environments, the apparatus comprising: wind detection logic to detect wind associated with the apparatus including a wearable computing device, wherein the wind is detected based on samples from multiple microphones and extraction and use of multiple features including spectral sub-band centroid (SSC) features and coherence features; and decision and execution logic to reduce wind noise associated with the detected wind.

Example 2 includes the subject matter of Example 1, wherein the wind detection logic is further to perform one or more of smoothing, data transformation, and wind classification based on the multiple features.

Example 3 includes the subject matter of Examples 1-2, wherein smoothing includes retaining a portion of past context, while integrating a portion of new context, and wherein the wind classification includes generating class labels as outputs based on multiple measurements corresponding to the multiple features used as inputs.

Example 4 includes the subject matter of Examples 1-3, wherein the SSC features comprise a metric for measuring a shape of a frequency spectrum from a high-frequency energy to a low-frequency energy, wherein the coherence features comprise a measure of similarity between signals.

Example 5 includes the subject matter of Examples 1-4, further comprising feature extraction logic to extract the SSC features and the coherence features from the multiple samples received as inputs from multiple channels associated with the wearable computing device.

Example 6 includes the subject matter of Examples 1-5, further comprising noise estimation logic to estimate the wind noise associated with the wind, wherein the samples are processed based on one or more of short-time fourier transform (STFT) and fast fourier transform (FFT), and wherein the wind classification is associated with feature constellation and results of the smoothing to determine presence of the wind and the wind noise.

Example 7 includes the subject matter of Examples 1-6, wherein the wearable computing device comprises one or more processors including a graphics processor co-located with an application processor on a common semiconductor package.

Some embodiments pertain to Example 8 that includes a method for facilitating wind detection and wind noise reduction in computing environments, the method comprising: detecting wind associated with a computing device including a wearable computing device, wherein the wind is detected based on samples from multiple microphones and extraction and use of multiple features including spectral sub-band centroid (SSC) features and coherence features; and reducing wind noise associated with the detected wind.

Example 9 includes the subject matter of Example 8, further comprising performing one or more of smoothing, data transformation, and wind classification based on the multiple features.

Example 10 includes the subject matter of Examples 8-9, wherein smoothing includes retaining a portion of past context, while integrating a portion of new context, and wherein the wind classification includes generating class labels as outputs based on multiple measurements corresponding to the multiple features used as inputs.

Example 11 includes the subject matter of Examples 8-10, wherein the SSC features comprise a metric for measuring a shape of a frequency spectrum from a high-frequency energy to a low-frequency energy, wherein the coherence features comprise a measure of similarity between signals.

Example 12 includes the subject matter of Examples 8-11, further comprising extracting the SSC features and the coherence features from the multiple samples received as inputs from multiple channels associated with the wearable computing device.

Example 13 includes the subject matter of Examples 8-12, further comprising estimating the wind noise associated with the wind, wherein the samples are processed based on one or more of short-time fourier transform (STFT) and fast fourier transform (FFT), and wherein the wind classification is associated with feature constellation and results of the smoothing to determine presence of the wind and the wind noise.

Example 14 includes the subject matter of Examples 8-13, wherein the wearable computing device comprises one or more processors including a graphics processor co-located with an application processor on a common semiconductor package.

Some embodiments pertain to Example 15 that includes a data processing system having a processing device coupled to a memory device, the processing device to: detect wind associated with the data processing device including a wearable computing device, wherein the wind is detected based on samples from multiple microphones and extraction and use of multiple features including spectral sub-band centroid (SSC) features and coherence features; and reduce wind noise associated with the detected wind.

Example 16 includes the subject matter of Examples 15, wherein the processing device is further to perform one or more of smoothing, data transformation, and wind classification based on the multiple features.

Example 17 includes the subject matter of Examples 15-16, wherein smoothing includes retaining a portion of past context, while integrating a portion of new context, and wherein the wind classification includes generating class labels as outputs based on multiple measurements corresponding to the multiple features used as inputs.

Example 18 includes the subject matter of Examples 15-17, wherein the SSC features comprise a metric for measuring a shape of a frequency spectrum from a high-frequency energy to a low-frequency energy, wherein the coherence features comprise a measure of similarity between signals.

Example 19 includes the subject matter of Examples 15-18, wherein the processing device is further to extract the SSC features and the coherence features from the multiple samples received as inputs from multiple channels associated with the wearable computing device.

Example 20 includes the subject matter of Examples 15-19, wherein the processing device is further to estimate the wind noise associated with the wind, wherein the samples are processed based on one or more of short-time fourier transform (STFT) and fast fourier transform (FFT), and wherein the wind classification is associated with feature constellation and results of the smoothing to determine presence of the wind and the wind noise.

Example 21 includes the subject matter of Examples 15-20, wherein the wearable computing device comprises one or more processors including a graphics processor co-located with an application processor on a common semiconductor package.

Some embodiments pertain to Example 22 that includes an apparatus to facilitate wind detection and wind noise reduction in computing environments, the apparatus comprising: means for detecting wind associated with the apparatus including a wearable computing device, wherein the wind is detected based on samples from multiple microphones and extraction and use of multiple features including spectral sub-band centroid (SSC) features and coherence features; and means for reducing wind noise associated with the detected wind.

Example 23 includes the subject matter of Example 22, further comprising means for performing one or more of smoothing, data transformation, and wind classification based on the multiple features.

Example 24 includes the subject matter of Examples 22-23, wherein smoothing includes retaining a portion of past context, while integrating a portion of new context, and wherein the wind classification includes generating class labels as outputs based on multiple measurements corresponding to the multiple features used as inputs.

Example 25 includes the subject matter of Examples 22-24, wherein the SSC features comprise a metric for measuring a shape of a frequency spectrum from a high-frequency energy to a low-frequency energy, wherein the coherence features comprise a measure of similarity between signals.

Example 26 includes the subject matter of Examples 22-25, wherein the processing device is further to extract the SSC features and the coherence features from the multiple samples received as inputs from multiple channels associated with the wearable computing device.

Example 27 includes the subject matter of Examples 22-26, wherein the processing device is further to estimate the wind noise associated with the wind, wherein the samples are processed based on one or more of short-time fourier transform (STFT) and fast fourier transform (FFT), and wherein the wind classification is associated with feature constellation and results of the smoothing to determine presence of the wind and the wind noise.

Example 28 includes the subject matter of Examples 22-27, wherein the wearable computing device comprises one or more processors including a graphics processor co-located with an application processor on a common semiconductor package.

Example 29 includes at least one non-transitory or tangible machine-readable medium comprising a plurality of instructions, when executed on a computing device, to implement or perform a method as claimed in any of claims or examples 8-14.

Example 30 includes at least one machine-readable medium comprising a plurality of instructions, when executed on a computing device, to implement or perform a method as claimed in any of claims or examples 8-14.

Example 31 includes a system comprising a mechanism to implement or perform a method as claimed in any of claims or examples 8-14.

Example 32 includes an apparatus comprising means for performing a method as claimed in any of claims or examples 8-14.

Example 33 includes a computing device arranged to implement or perform a method as claimed in any of claims or examples 8-14.

Example 34 includes a communications device arranged to implement or perform a method as claimed in any of claims or examples 8-14.

Example 35 includes at least one machine-readable medium comprising a plurality of instructions, when executed on a computing device, to implement or perform a method or realize an apparatus as claimed in any preceding claims.

Example 36 includes at least one non-transitory or tangible machine-readable medium comprising a plurality of instructions, when executed on a computing device, to implement or perform a method or realize an apparatus as claimed in any preceding claims.

Example 37 includes a system comprising a mechanism to implement or perform a method or realize an apparatus as claimed in any preceding claims.

Example 38 includes an apparatus comprising means to perform a method as claimed in any preceding claims.

Example 39 includes a computing device arranged to implement or perform a method or realize an apparatus as claimed in any preceding claims.

Example 40 includes a communications device arranged to implement or perform a method or realize an apparatus as claimed in any preceding claims.

The drawings and the forgoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein. Moreover, the actions of any flow diagram need not be implemented in the order shown; nor do all of the acts necessarily need to be performed. Also, those acts that are not dependent on other acts may be performed in parallel with the other acts. The scope of embodiments is by no means limited by these specific examples. Numerous variations, whether explicitly given in the specification or not, such as differences in structure, dimension, and use of material, are possible. The scope of embodiments is at least as broad as given by the following claims.

What is claimed is:

1. An apparatus comprising:

one or more processor coupled to memory, the one or more processors to:

detect wind associated with the apparatus including a wearable computing device, wherein the wind is detected based on samples from multiple microphones and extraction and use of multiple features including spectral sub-band centroid (SSC) features and coherence features, wherein the SSC features include one or more metrics for measuring a shape of a frequency spectrum from a high-frequency energy to a low-frequency energy, wherein the coherence features comprise one or more measures of similarities between signals, wherein the SSC features include low-dimensional SSC features that are computed or extracted for multiple channels associated with multiple microphones such that the SSC and coherence features are applied across multiple levels of wind intensities to perform one or more of smoothing and data transformation to facilitate wind classification of the wind; and performing the wind classification based on a constellation of features including the SSC and coherence features to determine presence of the wind, wherein wind noise associated with the detected wind is reduced.

2. The apparatus of claim 1, wherein the one or more processors are further to perform one or more of the smoothing, the data transformation, and the wind classification based on the multiple features.

3. The apparatus of claim 2, wherein the smoothing includes retaining a portion of past context, while integrating a portion of new context, and wherein the wind classification includes generating class labels as outputs based on multiple measurements corresponding to the multiple features used as inputs.

4. The apparatus of claim 1, wherein the one or more processors are further to extract the SSC features and the coherence features from the multiple samples received as inputs from the multiple channels associated with the wearable computing device.

5. The apparatus of claim 4, wherein the one or more processors are further to estimate the wind noise associated with the wind, wherein the samples are processed based on one or more of short-time fourier transform (STFT) and fast fourier transform (FFT), and wherein the wind classification is associated with feature constellation and results of the smoothing to determine presence of the wind and the wind noise.

6. The apparatus of claim 1, wherein the one or more processors comprise a graphics processor co-located with an application processor on a common semiconductor package.

7. A method comprising:

detecting wind associated with a computing device including a wearable computing device, wherein the wind is detected based on samples from multiple microphones and extraction and use of multiple features including spectral sub-band centroid (SSC) features and coherence features, wherein the SSC features include one or more metrics for measuring a shape of a frequency spectrum from a high-frequency energy to a low-frequency energy, wherein the coherence features comprise one or more measures of similarities between signals, wherein the SSC features include low-dimensional SSC features that are computed or extracted for multiple channels associated with multiple microphones such that the SSC and coherence features are applied across multiple levels of wind intensities to perform one or more of smoothing and data transformation to facilitate wind classification of the wind; and performing the wind classification based on a constellation of features including the SSC and coherence features to determine presence of the wind, wherein wind noise associated with the detected wind is reduced.

8. The method of claim 7, further comprising performing one or more of the smoothing, the data transformation, and the wind classification based on the multiple features.

9. The method of claim 8, wherein the smoothing includes retaining a portion of past context, while integrating a portion of new context, and wherein the wind classification includes generating class labels as outputs based on multiple measurements corresponding to the multiple features used as inputs.

10. The method of claim 7, further comprising extracting the SSC features and the coherence features from the multiple samples received as inputs from the multiple channels associated with the wearable computing device.

11. The method of claim 10, further comprising estimating the wind noise associated with the wind, wherein the samples are processed based on one or more of short-time fourier transform (STFT) and fast fourier transform (FFT), and wherein the wind classification is associated with feature constellation and results of the smoothing to determine presence of the wind and the wind noise.

12. The method of claim 7, wherein the wearable computing device comprises one or more processors including a graphics processor co-located with an application processor on a common semiconductor package.

13. At least one non-transitory machine computer-readable medium comprising instructions which, when executed by a computing device, cause the computing device to perform operations comprising:

detecting wind associated with the computing device including a wearable computing device, wherein the wind is detected based on samples from multiple microphones and extraction and use of multiple features including spectral sub-band centroid (SSC) features and coherence features, wherein the SSC features include one or more metrics for measuring a shape of a frequency spectrum from a high-frequency energy to a low-frequency energy, wherein the coherence features comprise one or more measures of similarities between signals, wherein the SSC features include low-dimensional SSC features that are computed or extracted for multiple channels associated with multiple microphones such that the SSC and coherence features are applied across multiple levels of wind intensities to perform one or more of smoothing and data transformation to facilitate wind classification of the wind; and performing the wind classification based on a constellation of features including the SSC and coherence features to determine presence of the wind, wherein wind noise associated with the detected wind is reduced.

14. The non-transitory computer-readable medium of claim 13, further comprising performing one or more of the smoothing, the data transformation, and the wind classification based on the multiple features.

15. The non-transitory computer-readable medium of claim 14, wherein the smoothing includes retaining a portion of past context, while integrating a portion of new context, and wherein the wind classification includes generating class labels as outputs based on multiple measurements corresponding to the multiple features used as inputs.

16. The non-transitory computer-readable medium of claim 13, further comprising extracting the SSC features and the coherence features from the multiple samples received as inputs from the multiple channels associated with the wearable computing device.

17. The non-transitory computer-readable medium of claim 16, further comprising estimating the wind noise associated with the wind, wherein the samples are processed based on one or more of short-time fourier transform (STFT) and fast fourier transform (FFT), and wherein the wind classification is associated with feature constellation and results of the smoothing to determine presence of the wind and the wind noise, wherein the wearable computing device comprises one or more processors including a graphics processor co-located with an application processor on a common semiconductor package.

* * * * *